United States Patent [19]

Ito et al.

[11] 4,089,600

[45] May 16, 1978

[54] CORONA DISCHARGE DEVICE FOR ELECTROPHOTOGRAPHIC COPYING MACHINE

[75] Inventors: Yoshio Ito, Kokubunji; Hajime Katayama; Hiroshi Nitanda, both of Tokyo; Masaru Yamaguchi, Yokohama, all of Japan

[73] Assignee: Canon Kabushiki Kaisha, Tokyo, Japan

[21] Appl. No.: 654,389

[22] Filed: Feb. 2, 1976

Related U.S. Application Data

[60] Continuation of Ser. No. 576,299, May 12, 1975, abandoned, which is a division of Ser. No. 348,093, Apr. 5, 1973, Pat. No. 3,883,240, which is a division of Ser. No. 120,132, Mar. 2, 1971, Pat. No. 3,784,297.

[30] Foreign Application Priority Data

Mar. 11, 1970 Japan ..... 45-20075
Apr. 15, 1970 Japan ..... 45-32112

[51] Int. Cl.[2] ..... G03G 15/02

[52] U.S. Cl. ..... 355/3 CH; 361/226

[58] Field of Search ..... 355/3 CH; 317/262 A; 250/324–326; 361/226

[56] References Cited

U.S. PATENT DOCUMENTS 3,762,811 10/1973 Matsumoto ..... 355/3 R

*Primary Examiner*—L. T. Hix
*Assistant Examiner*—M. L. Gellner
*Attorney, Agent, or Firm*—Fitzpatrick, Cella, Harper & Scinto

[57] ABSTRACT

A corona discharger includes a shield and a discharge wire extended between opposed ends of the shield and supported between its ends. The position of the wire is adjustable to control the distance between the wire and a surface of a member to be subjected to the corona discharge and a spring is arranged to maintain tension on the discharge wire regardless of the position of adjustment of the wire.

3 Claims, 44 Drawing Figures

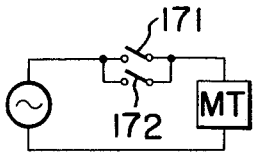
FIG. 23
FIG. 24
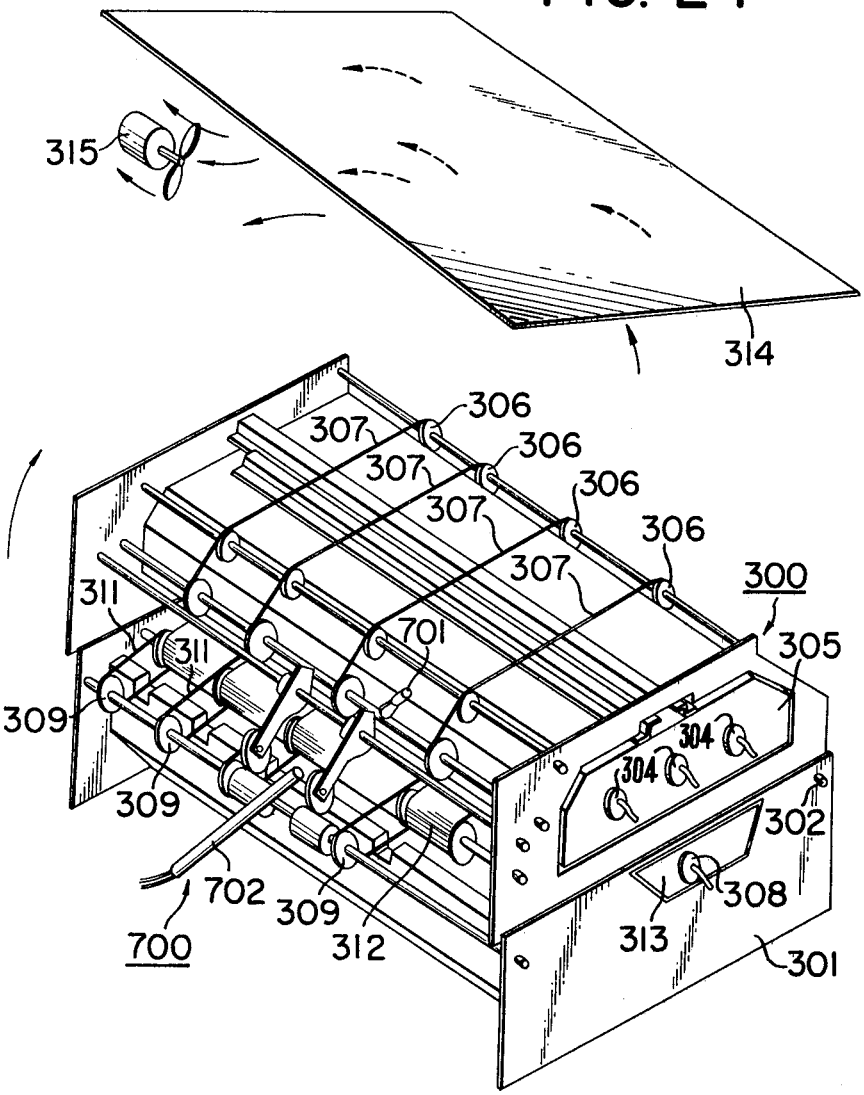

CORONA DISCHARGE DEVICE FOR ELECTROPHOTOGRAPHIC COPYING MACHINE

This application is a continuation of application Ser. No. 576,299 filed May 12, 1975, now abandoned, which is in turn a division of application Ser. No. 348,093 filed Apr. 5, 1973, now U.S. Pat. No. 3,883,240 which is a division of application Ser. No. 120,132 filed Mar. 2, 1971, now U.S. Pat. No. 3,784,297.

BACKGROUND OF THE INVENTION

1. Field of the Invention

The present invention relates to a photocopying machine and more particularly an electrophotographic copying machine of the type in which an original stand is reciprocated, exposure is made through a slit and an electrophotographic photosensitive member is in the form of a rotary drum. More specifically the present invention relates to an electrophotographic copying machine of the type in which an electrophotographic photosensitive member consisting of a photoconductive layer sandwiched between an insulating surface layer and an insulating or conducting member is used and an original in the form of a sheet or a thick original may be reproduced automatically, rapidly and economically upon copy media such as sheets of copy paper or the like (to be referred to as "copy paper" hereinafter in this specification).

2. Description of the Prior Art

In general, in the electrophotographic copying machines available in the market, both ordinary sheets of paper and photosensitive sheets are used for reproducing an original in the form of a sheet of a thick original. The reproduction cost is high in the electrophotographic copying machine of the type using photosensitive sheets. Therefore the electrophotographic copying machines of the type using paper sheets are widely used because the cost per copy is very low. However, the electrophotographic photosensitive members which are repetitively used must be replaced when damaged. The advantages of the electrophotographic copying machines of the type using paper sheets will be cancelled if the replacement of the electrophotographic photosensitive members is difficult or the re-adjustment of the electrophotographic copying machines is required after the replacement.

SUMMARY OF THE INVENTION

One of the objects of the present invention is to provide an improved electrophotographic copying machine (to be referred to as "photocopying machine" for brevity hereinafter) which is compact in size because a space required for replacement of an electrophotographic photosensitive member (to be referred to as "sensitive member or drum" for brevity hereinafter) may be reduced to the minimum and which facilitates the inspection and maintenance of various means required for the electrophotographic process and disposed around the sensitive drum or member after its removal.

Another object of the present invention is to provide an improved photocopying machine in which various processing means are arranged as units so that the mounting or removal and inspection and maintenance of these various units may be much facilitated.

According to the present invention there is provided an improved photocopying machine in which an original holder upon which is placed an original to be copied is disposed upon the top of the photocopying machine for reciprocal movement and the copy papers are fed one by one by feeding means and discharged after the copying operation.

At the center of the main body of the housing is disposed a rotary sensitive drum to the peripheral surface of which is applied a lamination consisting of a photoconductive layer sandwiched between an insulating surface layer and an insulating or conducting layer. Around the sensitive drum are disposed first charging means, simultaneous exposure-charging means, whole-surface-illumination means, developing means, third charging means, image transfer means and cleaning means in the order named in the direction of rotation of the rotary sensitive drum.

The rotary sensitive drum is positively or negatively charged by dc corona discharge generated by the first charging means. The dc corona discharge whose polarity is opposite to that of the dc corona discharge by the first charging means or ac corona discharge is applied to the rotary sensitive drum by the simultaneous exposure-charging means simultaneously when a light or radiation image of the original to be reproduced is exposed or projected upon the rotary sensitive drum. By the whole-surface exposure means, the whole surface of the rotary sensitive drum is uniformly exposed so as to increase the contrast of the image. The electrostatic latent image thus formed may be developed into a positive or negative toner image by the toner which is charged with a polarity opposite to or the same as that of the latent image by the developing means. The third charging means is not necessarily required, but may be used with a desired polarity so that the image transfer efficiency may be improved. The toner image thus developed may be transferred by the image transfer means to a copy paper. After the image transfer the toner which still remains upon the rotary sensitive drum is removed or cleaned by the cleaning means. Thus one cycle of copying or reproduction operation is completed as far as the rotary sensitive drum is concerned. The copy paper is separated from the rotary sensitive drum by a separating means and fixed in the fixing means and then discharged out of the photocopying machine.

BRIEF DESCRIPTION OF THE DRAWINGS

FIG. 23 is an electric circuit diagram thereof;

FIG. 24 is a perspective view of one embodiment of fixing means in accordance with the present invention;

DESCRIPTION OF THE PREFERRED EMBODIMENTS

Figure 1:
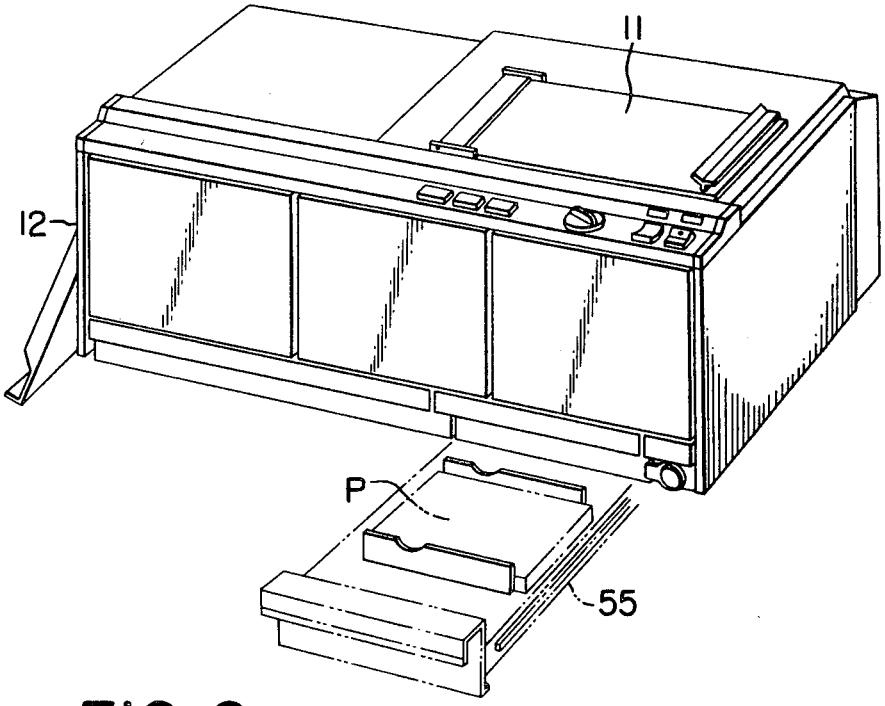
FIG. 1 is a perspective view illustrating the outer apperance of a photocopying machine in accordance with the present invention.

FIG. 1 shows a perspective view of an embodiment of the present invention showing its outer apperance. Upon an original holder 11 is placed an original with its surface faced down. The original holder 11 is reciprocated for carrying out the slit exposure. The sheets of copy paper P are fed one by one by a feeding means, processed by an electrophotographic device and discharged out of an outlet 12.

Figure 2:
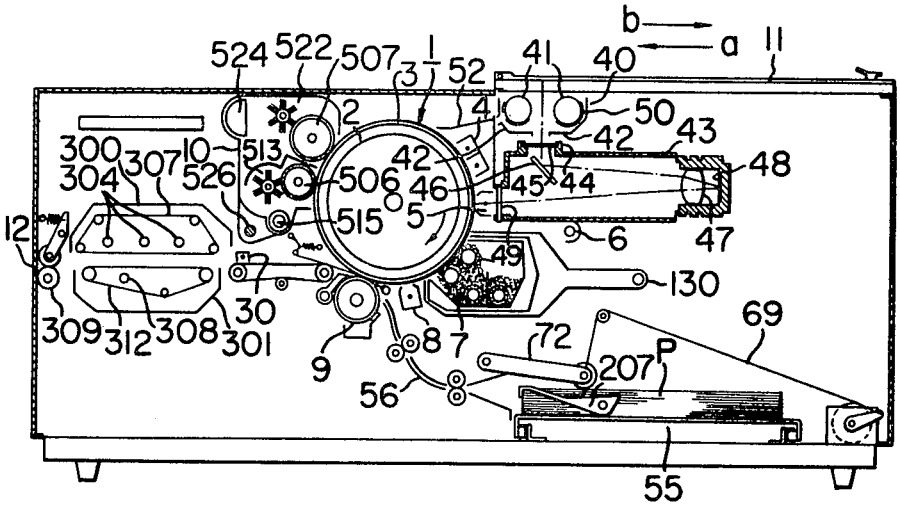
FIG. 2 is a longitudinal front view thereof.

Referring to FIG. 2, upon the peripheral surface of a drum 2 rotating in the direction indicated by the arrow is formed an electrophotographic sensitive layer 1 consisting of a photoconductive layer sandwiched between a surface insulating layer and a conducting or insulating layer. Around the rotary drum 2 are disposed in the order named a first charging means 3, a simultaneous exposure-charging means 5, a whole-surface exposure means 6, a developing means 7, a third charging means 8, a transfer means 9 and a cleaning means 10.

The DC corona discharge is imparted by the first charging means 4 to the surface of the rotary sensitive drum 2 so that the sensitive layer 3 may be positively or negatively charged. By the simultaneous exposure-charging means 5 the DC corona discharge having the polarity opposite to that applied by the first charging means 4 or the AC corona discharge is applied to the sensitive layer 3 simultaneously when a light or radiation image of the original to be copied is projected upon the sensitive layer 3 or drum 1 to produce an electrostatic image.

Thereafter by the whole-surface exposure means 6 such as a fluorescent lamp, the electrostatic latent image is uniformly illuminated so as to increase the action of the latent image as the external field, thereby increasing the contrast of the electrostatic latent image. By use of the toner having a polarity opposite to that of the electrostatic latent image, it is developed by the developing means 7. Alternatively, the electrostatic latent image may be developed into a negative image by use of the toner having the same polarity as that of the latent image. It is preferable to use the magnet brush or fur brush developing method.

The third charging means 8 is not necessarily required. However, it is used with a suitable polarity so as to improve the efficiency of transferring to the copy paper P the toner image formed upon the sensitive drum 1. The toner image is transferred electrostatically to the copy paper P by the transfer means 9. The toner still remaining upon the sensitive drum 1 after the image transfer is wiped off by cleaning rollers in the cleaning means 10.

The copy paper P upon which is transferred the toner image from the sensitive drum 1 is separated from the sensitive drum by a separating means, fixed by the fixing means and discharged out of the photocopying machine from the outlet 12. Since the copy paper P is charged, the electrostatic charge is removed from the copy paper P by an AC charging means 30.

In addition to the means described above, the photocopying machine in accordance with the present invention further includes driving means, exposure means, feeding means, control means and so on and the present invention is characterized by the arrangement thereof and the assembly and disassembly thereof as will be described in more detail hereinafter.

ORIGINAL HOLDER AND DRIVING MEANS

Figure 3:
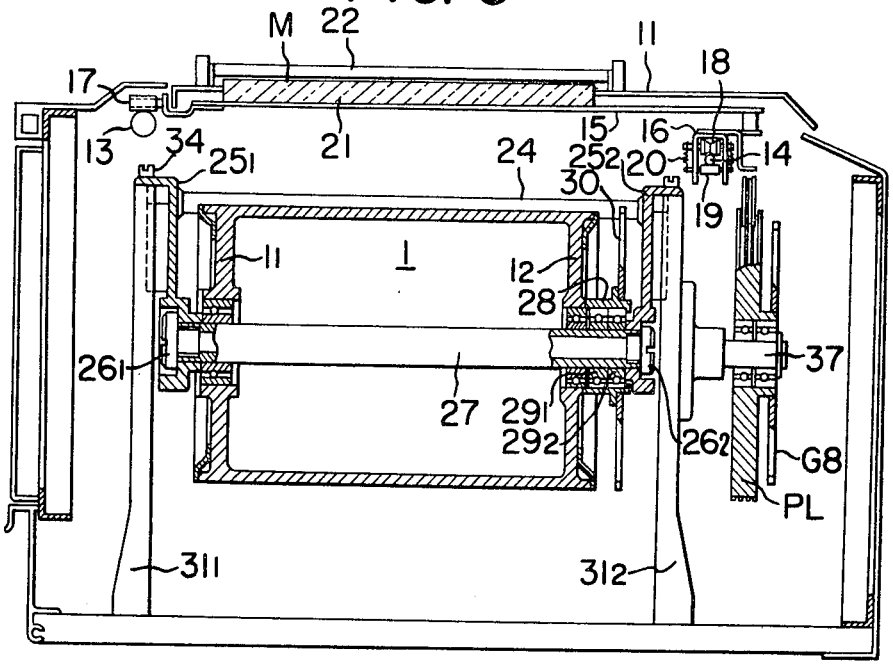
FIG. 3 is a transverse sectional view thereof illustrating a rotary sensitive drum unit and a reciprocable original holder.

As shown in FIG. 3, the original holder 11 has two rollers 17 and 18. The roller 17 rides on a rail 13 extending between frames of the housing while the roller 18 is enclosed in a channel-like member 16 and rides on a rail 14 mounted between the frames. It is noted that the rail 14 and the roller 18 in the channel-like member 16 are disposed below an inner frame 15 of the original holder 11. The deviation in the transverse direction, that is to the right and left of the original holder 11 may be prevented by the roller 18 which has a configuration of a drum as shown in FIG. 3 while the vertical deviation may be prevented by the combination of a roller vertically movably fixed to the channel-like member 16 and made in contact with the undersurface of the rail 14 under the force of a spring 20 loaded between the lower roller 19 and the upper roller 18. A transparent plate 21 such as a glass plate is mounted on the inner frame 15 of the original holder 11 and a pressure plate 22 for pressing the original against the transparent plate 21 is provided.

Still referring to FIG. 3, a shaft 27 of the sensitive drum 1 extending through bearings 23 of end plates $1_1$ and $1_2$ is supported by supporting plates $25_1$ and $25_2$ and retained by retaining members $26_1$ and $26_2$. Stays 24 are fixed to the supporting plates $26_1$ and $26_2$ which in turn are fixed to side plates $31_1$ and $31_2$ fixed to the housing. A driving gear 30 is mounted on a boss of the sensitive drum 1. Thus, the sensitive drum unit is constituted.

A drive gear $G_4$ for driving the sensitive drum unit is provided with a control member CAM-1 which is associated with a switch MS-1 mounted upon the side plate $31_2$ for controlling the original holder, a counter and the toner supply.

Figure 4:
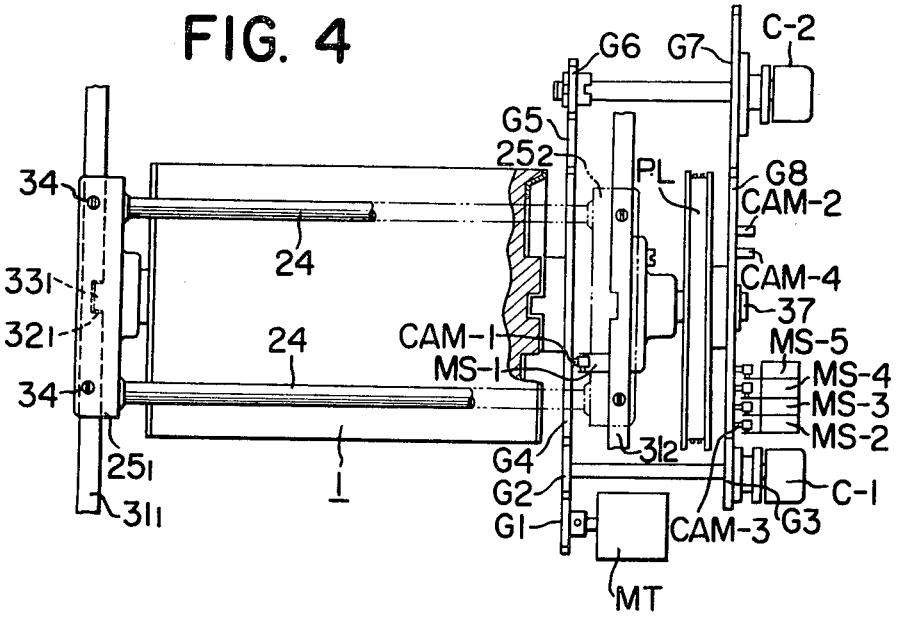
FIG. 4 is a top view of the rotary sensitive drum unit.
Figure 6:
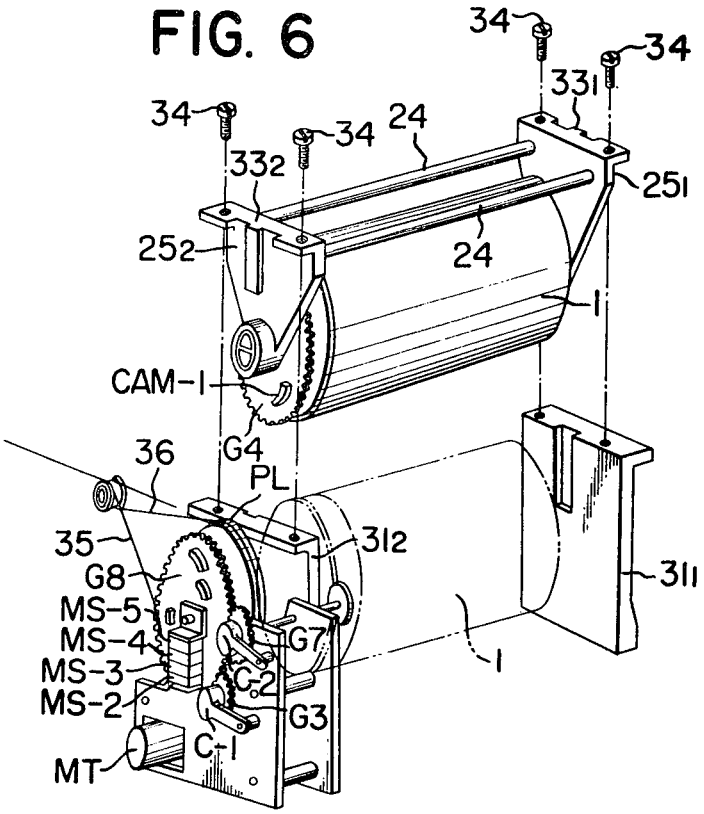
FIG. 6 is a perspective view illustrating the mounting and removal of the rotary sensitive drum unit.

Ridges 33 are formed on the supporting plates $25_1$ and $25_2$ while their mating grooves 32 are formed in the side plates $31_1$ and $31_2$ as shown in FIGS. 4 and 6 so that the drum unit may be easily, rapidly and vertically mounted on or removed out of the side plates $31_1$ and $31_2$. The drum unit may be securely held in position by means of setscrews 34.

The sensitive drum 1 is driven by an electric motor MT through a gear $G_1$, an idler $G_2$ and the drive gear $G_4$ carried by the drum shaft 27. The sensitive drum 1 is always rotated in a predetermined direction in operation.

The original holder 11 is moved in the direction indicated by the arrow *a* in FIG. 2 when the exposure is made, and upon completion of the exposure the original holder 11 is reversed in the direction of the arrow *b* to the initial position. For this purpose, two belts or wires 35 and 36 are wrapped around a guide pulley R and a drive pulley PL in the opposite directions. One end of each of the belts or wires 35 and 36 are fixed to the channel-like member 16 while the other ends are fixed to the drive pulley PL. In order to make one reciprocation of the original holder in one cycle operation, two clutches C-1 and C-2 are provided as shown in FIG. 4.

In response to a signal from a start button, the main motor MT starts to rotate the sensitive drum 1 through the gears $G_1$, $G_2$ and $G_4$. When the switch MS-1 is actuated by the control member CAM-1 of the gear $G_4$ carried by the sensitive drum 1, the clutch C-1 is actuated so as to transmit the power from the main motor MT to a drive gear $G_8$ through the gears $G_1$, $G_2$, clutch C-1, and a gear $G_3$.

Figure 5:
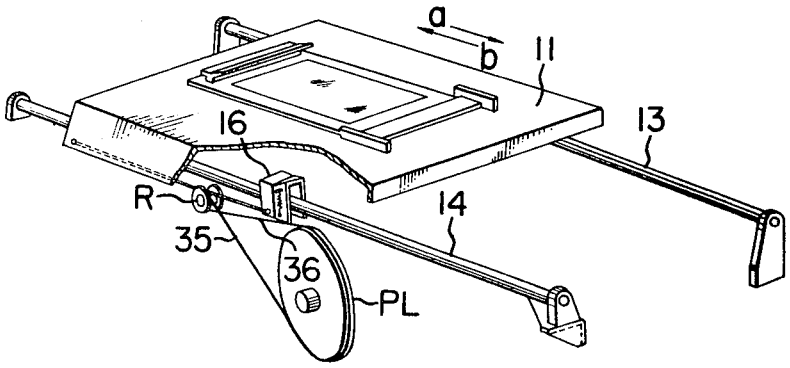
FIG. 5 is a perspective view of the original holder and its reciprocating means.

The drive gear $G_8$ is carried by a shaft 37 which also carries the pulley PL. Therefore the drive pulley 37 rotates in the direction of the arrow C in FIG. 5, winding the wire 35 while unwinding the wire 36. As a consequence, the original holder 11 is moved in the direction indicated by the arrow *a* at a predetermined speed, so that the original is exposed through a slit and the light image is continuously projected upon the sensitive drum 1 through the simultaneous exposure-charging means 5. As a consequence, an electrostatic latent image is formed upon the sensitive drum 1 which has been previously charged by the first charging means 4.

The peripheral speed of the sensitive drum 1 relative to the speed of the original holder 11 in the direction of the arrow *a* is predetermined. Upon completion of the going stroke of the original holder 11, a stroke cam CAM-2 (See FIG. 4) mounted upon the drive gear $G_8$ actuates a microswitch MS-3 fixed upon the housing so that the clutch C-1 is disengaged while the clutch C-2 is engaged. Whereas the sensitive drum 1 rotates in the same direction, the original holder 11 is returned to its initial position in the direction indicated by the arrow *b* by the gear train of $G_1$, $G_2$, $G_4$, $G_5$, the clutch C-2, $G_7$ and $G_8$. In this case, the original holder 11 may be returned quickly when the number of teeth of the gear $G_7$ which is in mesh with the gear $G_8$ used in the return stroke of the original holder 11 is less than that of the gear used in the going stroke. This quick return stroke permits the high speed copying operation.

When the original holder 11 returns to its initial position, the stroke cam CAM-3 of the drive gear $G_8$ actuates a microswitch MS-2 (see FIG. 4) so that the main motor MT is temporarily applied with brake so as to stop the original holder 11. A short time after the orginal holder 11 has been stopped, the clutch C-2 is disengaged so that the original holder 11 is completely disconnected from the main motor MT so that the original holder 11 may be held in its initial position. Simultaneously the sensitive drum 1 is also stopped. The above described two-step operation of first stopping the original holder 11 and then disconnecting it from its driving means is employed to absorb the inertia of the original holder in its return stroke.

EXPOSURE MEANS

Figure 7:
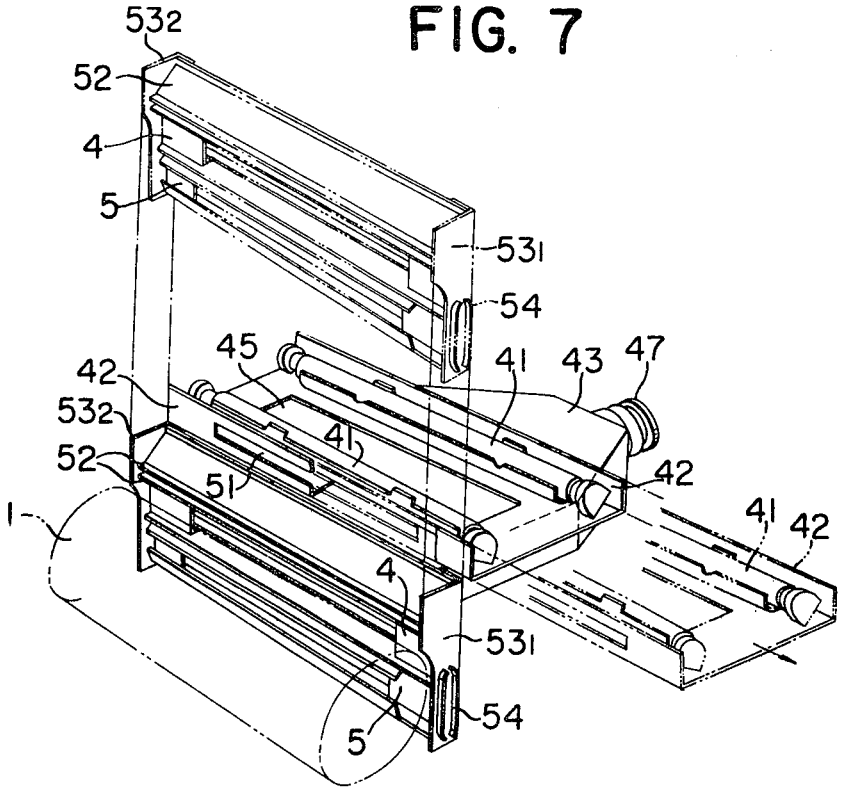
FIG. 7 is a view illustrating the mounting and removal of means for illuminating the original and charging means unit.

As shown in FIGS. 2 and 7, an illumination system 40 includes a light source such as fluorescent lamps 41 for illuminating the original, shielding plates 42 and cooling means such as a fan (not shown) which is used for cooling the lamps 41 so as to prevent the decrease of its illumination efficiency.

The cooling air from the fan is directed in the longitudinal direction of a space defind by the original holder 11, the shielding plates 42 and a black box 43 so that the fluorescent lamps 41 may be cooled along their entire lengths. When the fluorescent lamps 41 are turned on for exposure, a current twice the rated current is supplied to increase the luminous intensity. However, when no exposure is made, the lamps 41 are normally turned on by the rated current so that there may be no warming-up time and that its service life may be increased.

Light reflected by the original passes through a transparent plate 45 retained in position by retaining member 44 for preventing dust or the like from entering the black box 43 and is re-directed by a first reflecting mirror 46 inclined at 45° relative to the horizontal line toward an in-mirror type lens 47. The in-mirror type lens 47 has such a construction that the conventional lens is divided into two parts along its symmetrical axis and a mirror 48 is disposed at the center so that light reflected by the second mirror 48 may pass through the lens 47 and a transparent plate 49 for preventing the dust or the like from entering the black box 43 and may be projected upon the sensitive drum 1 through an opening of the simultaneous-exposure-charging means 5. A conducting transparent plates such as NESA glass may be used as the dust-proof transparent plate 49 so that the charging efficiency of the simultaneous exposure-charging means 5 may be improved.

As shown in FIG. 2, a reflector 50 for the lamp 41 is partly cut away so that the intensity of light from a portion of the lamp 41 having no reflector may be reduced, whereby the original may be uniformly illuminated regardless of the reduction in light quantity or fall-off of luminance in the peripheral portion of the lens 47. As shown in FIG. 7, a slit 51 is formed through the shielding plate 42 so that light from the light source may be directed toward the sensitive drum 1 by a guide plate 52 for effecting the pre-exposure before the sensitive drum 1 reaches the first charging means 5. The effect of the preexposure is that a better image may be always produced under the constant conditions as is disclosed in detail in U.S. Ser. No. 57732 filed July 23, 1970.

The light guide plate 52, the first charging means 4 and the simultaneous exposure-charging means 5 are formed as a unitary construction with the side plates $53_1$ and $53_2$ which are provided with guides 54 (See FIG. 7) for vertically mounting or dismounting the unit. Therefore, the inspection and maintenance of the first charging means 4 and the simultaneous exposure-charging means 5 are much facilitated. This arrangement also facilitate the replacement of the sensitive drum 1.

The light source 41 is made into a unitary construction with the shielding plate 42 so as to facilitate the replacement and cleaning thereof since the unit may be drawn toward an operator.

ELECTROPHOTOGRAPHIC PROCESSING MEANS

In response to the signal from the start switch the sensitive drum 1 starts to rotate. Around the sensitive drum are disposed the first charging means 4 and the simultaneous exposure-charging means 5 where the sensitive drum 1 rotating in synchronism with the original holder 11 is simultaneously exposed and charged so that an electrostatic latent image is produced. By means of the whole-surface exposure means 6 the sensitive drum 1 is uniformly illuminated so as to form a high contrast latent image. Prior to the first charging, the pre-exposure may be effected by light passing through the slit 51.

Figure 8:
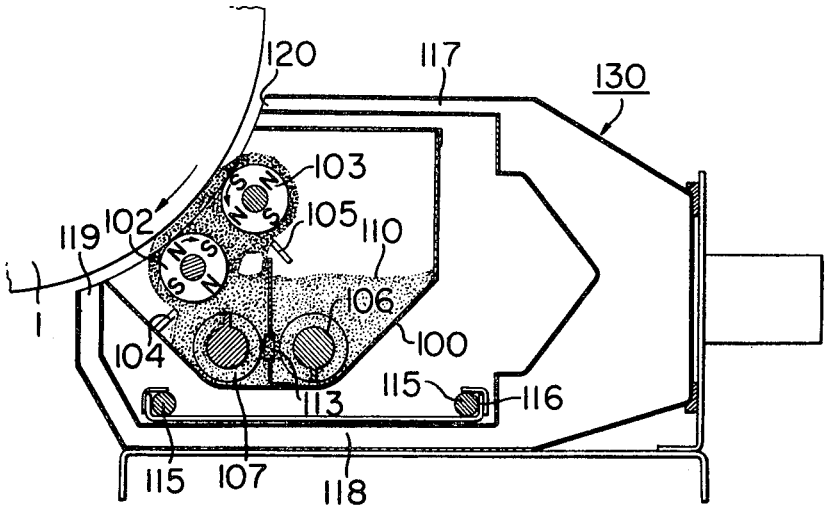
FIG. 8 is a sectional view of a developing means.

As shown in FIG. 8, the developing means 8 includes a pair of side plates 101 and a bottom plate which defines a box or container, in which are housed two magnet brushes 102 and 103 rotatably supported between the side walls 101, two doctor blades 104 and 105 and mixing screws 106 and 107.

Each of the magnet brushes 102 and 103 comprises a non-magnetic shaft and a magnet roll in which the north and south poles are alternatively arrayed. It should be noted that the magnet brushes 102 and 103 are so arranged that the opposite poles may oppose to each other as shown in FIG. 8.

Figure 9:
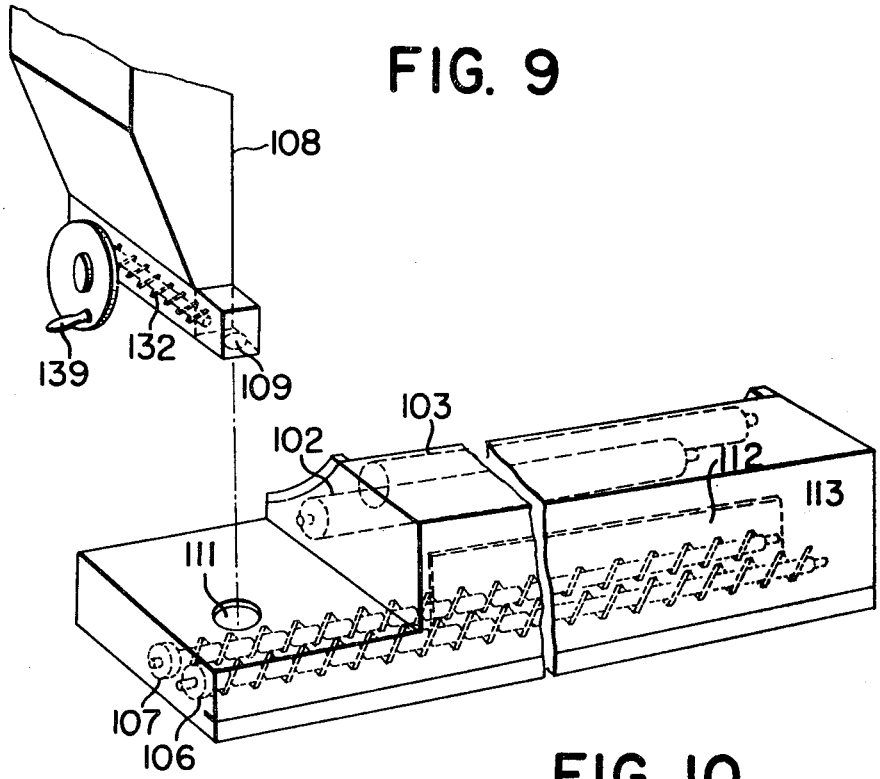
FIG. 9 is a perspective view illustrating means for supplying the developing agent to the developing means.

Developing agent 110 consists of toner and finely divided iron powder (carrier), which may be mixed sufficiently by the mixing screws 106 and 107 while moved toward the magnet brushes. The developing agent is attracted by the magnet brushes 102 and 103. The developing agent is supplied by a predetermined quantity from a hopper 108 shown in FIG. 9. The developing agent 110 is dropped onto one end of the mixing screw 106 through an opening 109 of the hopper 108 and an opening 111 of the developing means. The mixing screw 106 mixes the condensed developing agent 114 supplied from the hopper 108 with the developing agent 110 and feeds the mixture toward the other mixing screw 107. A partition wall 112 is disposed between the mixing screws 106 and 107 so that the developing agent 110 is fed into the developing means 7 only by the mixing screw 106.

A port 113 is formed through the partition wall 112 for communication between the chambers of the mixing screws 106 and 107 so that the developing agent 110 fed into the developing means 7 by the mixing screw 106 is fed toward the mixing screw 107 through the port 103 and then toward the developing means by the mixing screw 107. The developing agent 110 is attracted by the first magnet roller 102 and then transferred to the second roller 103 by the magnetic force so that the developing agent uniformly adheres to the second roller 103 to form the so-called magnet brush.

When the surface of the sensitive drum 1 upon which is formed the electrostatic latent image is rubbed by the leading edges of the magnet brush at which the magnetic forces are generally weak, the leading edges are attracted by the sensitive drum 1 and cut off by the electrostatic force so that the image is fogged or deteriorated. To prevent the magnet brushes from impairing the image, the blades 104 and 105 are provided so as to cut the magnet brush to a predetermined height. The magnet rollers 102 and 103 are rotated in the directions indicated by the arrows in FIG. 8 and the latent image is developed by the magnet brush formed in the space between the sensitive drum 1 and the pair of magnet rollers 102 and 103. Thus, the latent image is developed into the visible toner image.

The developing means 7 may be mounted in the housing and removed therefrom through guides 115 fixed to the housing and guides 116 fixed to the main body.

Conduits 117 and 118 surround the developing means 7, open at 119 and 120 toward the sensitive drum 1 as dust collecting openings and are connected to dust collecting means 130. The scattered developing agent may be collected through the openings 119 and 120 and the conduits 117 and 118 into a bag in the dust collecting means 130 so that the interior of the photocopying machine will not be contaminated by the developing agent scattered by the magnet rollers 102 and 103. The dust collecting means 130 and the developing means 7 are provided as separate units so that there is an advantage that the handling of the developing means 7 may be much facilitated.

Figure 10:
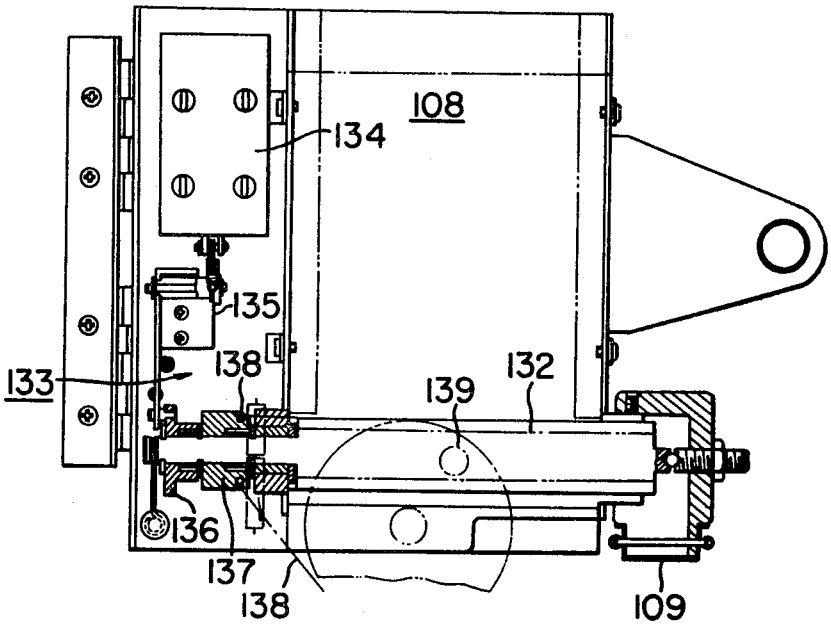
FIG. 10 is a fragmentary front view thereof on enlarged scale.
Figure 14:
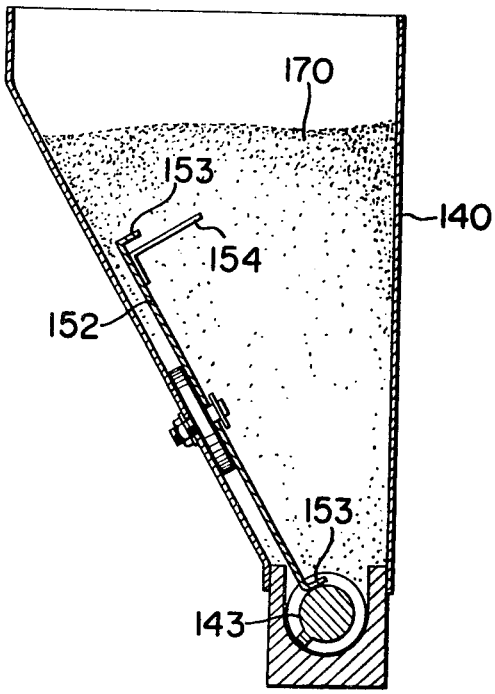
FIG. 14 is a side view thereof.
Figure 11:
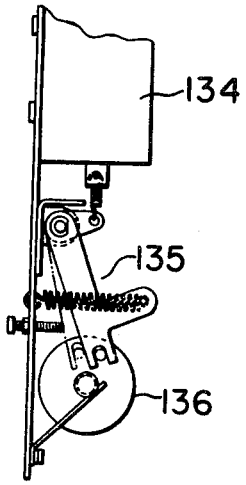
FIG. 11 is a side view thereof.

As shown in FIG. 10, the hopper 108 has its left side fixed to the main body by means of a hinge $108_1$ so that it may be opened when the developing means 7 is to be removed or when the developing agent is to be supplied into the hopper 108. Since the hopper 108 and the developing means 7 are provided as separate units, the handling of the developing means 7 and the supply of the developing agent into the hopper 108 may be much facilitated.

In the lower portion of the hopper 108 is disposed a developing agent feed roller 132 driven by a driving means 133 comprising a plunger magnet 134 actuable in response to a signal from a switch MS-1 to be actuated by the control member CAM-1 on the drive gear $G_4$, a means 135 such as a ratchet mechanism for converting the reciprocation of the plunger into the rotary motion and one-way clutch free wheels 136 and 137 carried by the feed roll 132. Therefore, the feed roll 132 is rotated when the plunger magnet 134 is energized so that a predetermined quantity of the developing agent 114 may be dropped into the developing means 7 through the opening 109.

When the supply of the developing agent to the developing means 7 by the automatic feeding device is not sufficient because a large number of copies must be reproduced from an original, a crank arm 139 disposed outside of the hopper 108 (See FIG. 9) is rotated so as to manually drive the feed roller 132 through a belt 138 and the one-way clutch 137 to feed a desired amount of developing agent. It is possible to use a developing agent feeding means of the type having a feed opening, a cover of this opening and a manual lever to open and close this cover.

Figure 12:
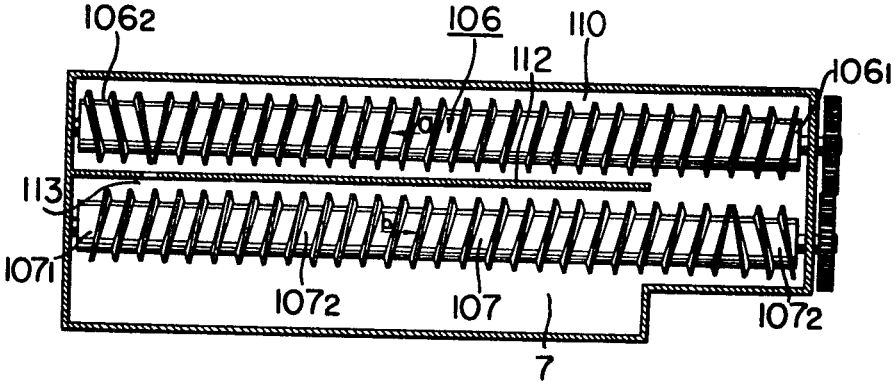
FIG. 12 is a top view of means for circulating the developing agent in the developing means.

Next referring to FIG. 12, the function of the mixing screws 106 and 107 will be described. The developing means in accordance with the present invention has a function of developing a visible image by attracting the developing agent by the magnet rolls so as to form the magnet brush and rubbing the latent image on the sensitive drum by the magnet brush to adhere the toner to the latent image. Therefore, it is apparent that the ratio of the carrier to the toner is reduced as one copy is reproduced. It is therefore important in an automatic photocopying machine to supply a predetermined quantity of developing agent by always supplying the toner and mixing it sufficiently so that the tone of the developed image may be maintained constant on every copy paper.

In the instant embodiment of the present invention, the pair of screws 106 and 107 are disposed on both sides of the partition walls 112 in such a way that the developing agent may be circulated along the axes of the screws 106 and 107. In order that the developing agent may be transferred from one screw to another at the end of the screw through the communication ports such as 113 the directions of the screws are reversed as shown at $106_2$ and $107_2$. In addition the flow rate of the developing agent through at least one port is made smaller than the feed by the feed screw. The developing agent including the toner supplied is moved in the direction indicated by the arrow by the feed screws 106 while the developing agent is mixed and is reversed at $106_2$ so that the developing agent is accumulated at $106_2$. The accumulated developing agent is mixed and moved toward the developing means 7 in a predetermined quantity through the port 113. The developing agent is moved by the return screw 107 and attracted by the magnet roller 102. In this case, the excess developing agent is removed by the blade 104. The developing agent upon the magnet roller 102 is then transferred to the magnet roller 103 where the developing agent forms the magnet brush which develops the latent image upon the sensitive drum 1. The excess developing agent on the magnet brush of the magnet roller 103 is also removed by the blade 105 and transported in the direction indicated by the arrow by the return screw 107. In this case a portion of the developing agent removed by the blade 105 from the magnetic roller 103 may be attracted by the magnet roller 102 again. The developing agent is circulated in the developing means in the manner described above.

The developing agent transported by the return screw 107 toward its end is reversed at $107_2$ and redirected into the feeding section 110. Thereafter the developing agent is circulated in the manner described above.

The arrangement described above for circulating the developing agent has the following advantages:

(1) The quantity of the circulating developing agent may be maintained constant because the circulating developing agent may be maintained constant because the circulation is controlled by the port 113 formed through the partition plate 112 so that (a) the quantity of developing agent adhered to the magnet rollers 102 and 103 and the quantity of the developing agent to be exchanged may be maintained constant, whereby the density of the image may be statibilized or maintained uniform;

(b) the quantity of developing agent removed by the blades 104 and 105 may be maintained constant, which means that the loads on the blades are constant, whereby the selection of a motor is simple; and (c) the quantity of circulating developing agent may be maintained at minimum, which means that the fatigue of developing agent (the decrease in developing ability) may be minimized.

(2) The toner supplied from the hopper or the like may be immediately and sufficiently mixed with the developing agent discharged out of the developing means 7.

(3) The developing agent transported by the feed screw 106 toward the port 103 is sufficiently mixed at $106_2$ (the reversed portion) before a predetermined quantity of developing agent is fed toward the screw 107 through the port 113 so that even though the concentration of the toner may be rapid, no excess toner concentration will occur.

(4) Both of the screws 106 and 107 may be of the same construction so that they may be provided in a simple manner and at less cost.

The diameter of the opening of the port 113 may be adjusted by means of an adjusting plate or the like so that the effective opening of the port 113 may be adjusted to permit the rather fast consumption of toner in case of copying a picture or the like and then may be reduced in case of copying an original bearing only characters or the like, which requires less consumption of toner.

Figure 13:
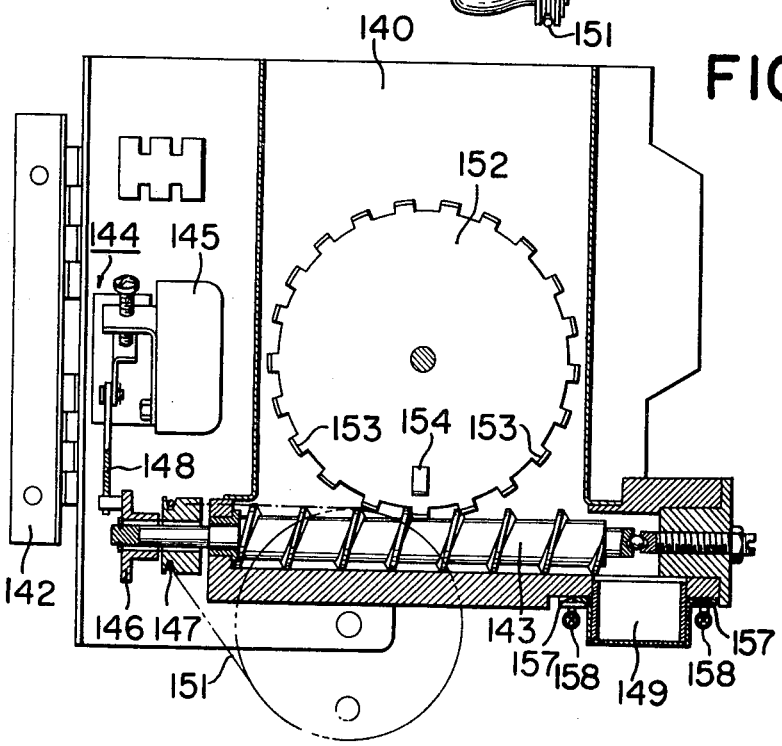
FIG. 13 is a longitudinal front view of another embodiment of means for supplying the developing agent in accordance with the present invention.

FIGS. 13–19 illustrate another embodiment of developing agent feed means in accordance with the present invention. As shown in FIG. 13, a hopper 140 has its left side hinged to the main body by a hinge 142 in such a way that the hopper may be opened when the developing means is to be removed out of the photocopying machine or when the developing agent or toner is to be supplied into the hopper 140. This arrangement facilitates the handling of the developing means and the supply of the developing agent into the hopper 140.

A toothed wheel 152 having square or crown-shaped teeth 153 is rotatably disposed inside the hopper 140 and is in mesh with a feed screw 143 so that the toothed wheel 152 may be intermittently rotated as the feed screw 143 rotates. At least one mixing blade 154 is mounted upon the toothed wheel 152 so as to mix the supplied developing agent 170 in the hopper 140. This arrangement serves to prevent the bridging phenomenon of developing agent, the arrangement being very advantageous.

Since the hopper 140 is hinged as described above, its discharge opening 149 must be closed unless it coincides with a feed opening 169 of the developing means. The manual operation is cumbersome and tends to cause the contamination of the interior of the photocopying machine. It is therefore preferable that the discharge opening 149 may be automatically opened and closed.

Figure 15:
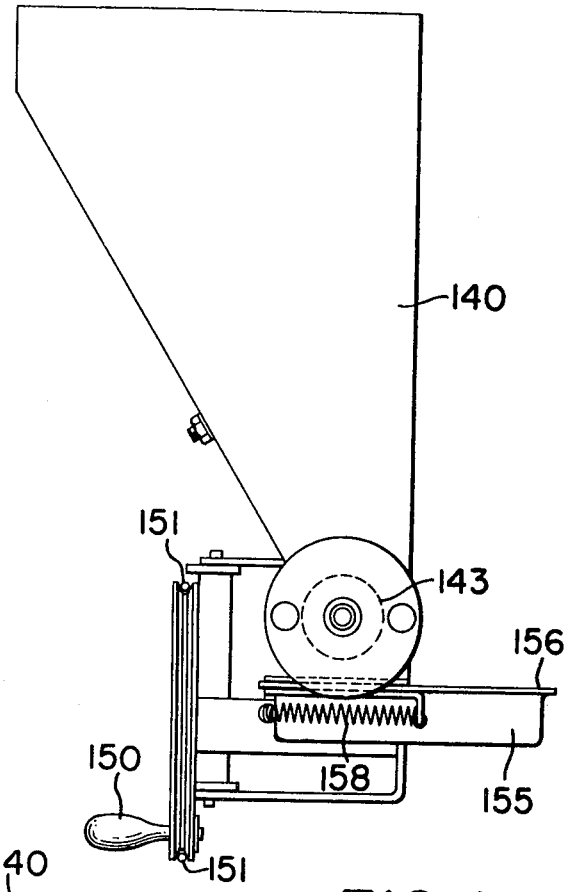
FIGS. 15 and 16 are side views illustrating one embodiment of means for opening or closing a discharge opening of a hopper.
Figure 16:
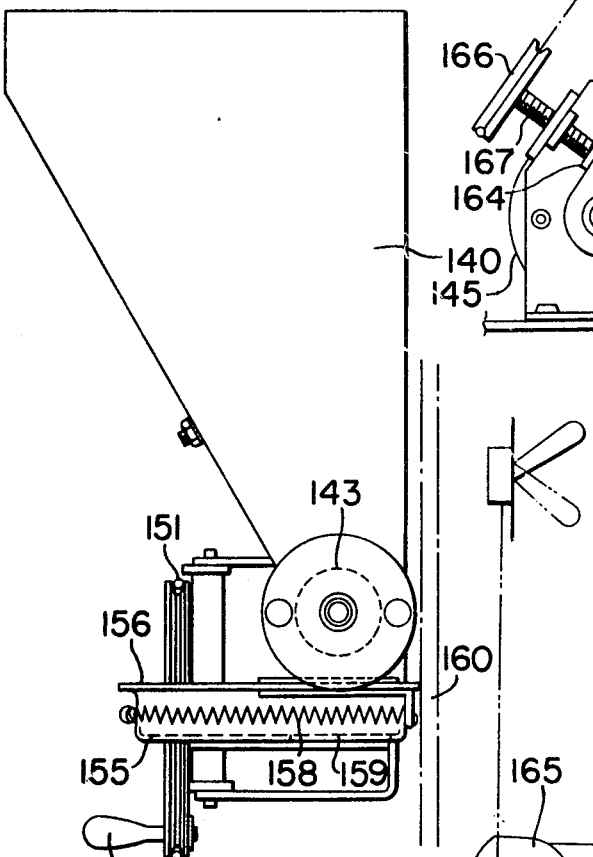

As shown in FIGS. 13, 15 and 16, the flange 156 of a cover 155 is fitted into a guide groove 157 in the discharge opening 149 and is biased by a spring 158. A discharge opening 159 mating with the discharge opening 149 of the hopper 140 is provided in the cover 155. When the hopper 140 is opened to the left in order to supply the developing agent, the cover 155 is positioned as shown in FIG. 15 under the bias of the spring 158 so that the discharge opening 149 of the hopper 140 is closed by the cover 155 at its portion not provided with the discharge opening 150. As a consequence no developing agent is discharged out of the hopper 140 through the discharge opening 149.

When the hopper 140 is returned to its operative position, the cover 155 is moved to a position as shown in FIG. 16 against the spring 158 by a side plate 160 of the main body of the photocopying machine so that the discharge opening 149 coincides with the discharge opening 159 of the cover 155. Therefore, the developing agent in the hopper 140 may be dropped into the opening 169 of the developing means by a feed roller 143.

The quantity of condensed developing agent to be supplied is varied depending upon the originals. That is in case of an original having large black areas or portions a large quantity of developing agent is supplied. On the other hand in case of an original having less black portions a less quantity of developing agent is supplied. This is true when the sizes of copy papers are varied. The automatic developing agent feeding means is normally adjusted so as to supply a less quantity and if required a large quantity of developing agent may be supplied by the manual operation in the manner described above.

Figure 17:
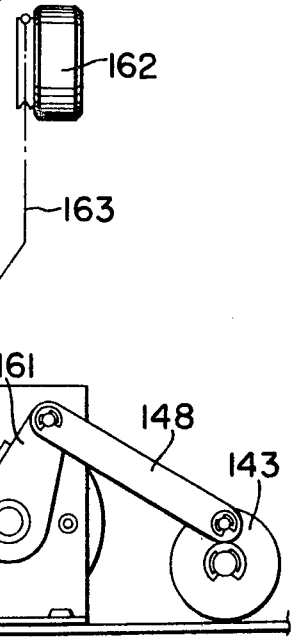
FIGS. 17 and 18 are front view illustrating means for adjusting an angle of rotation of a spiral feed roller disposed in the hopper shown in FIGS. 15 and 16.
Figure 18:
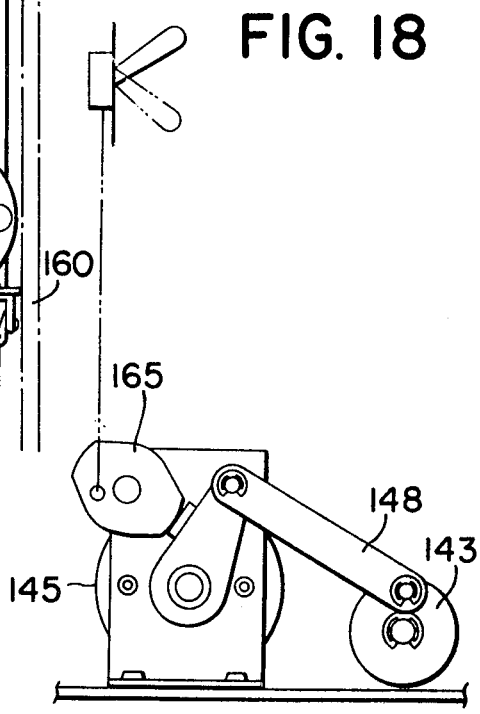
Figure 19:
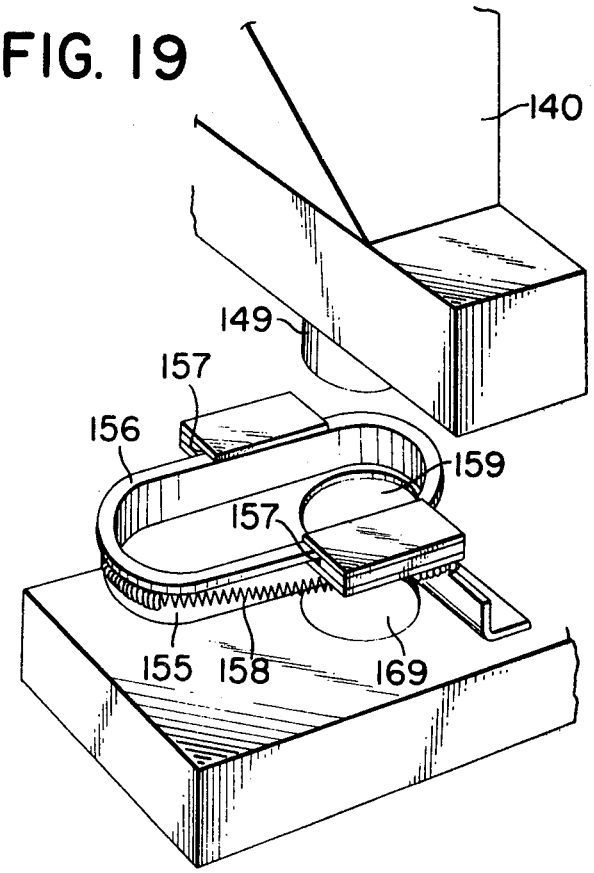
FIG. 19 is a perspective view of the opening and closing means shown in FIGS. 15 and 16.

The quantity of developing agent to be supplied may be automatically varied if the feed by the feed roller 143 is varied. This arrangement is illustrated in FIGS. 18 and 19, in which the angular displacement of a rotary solenoid 143 is varied so as to control the feed by the feed roller 143. FIG. 17 shows that the angular displacement of a crank 161 by the rotary solenoid 145 is controlled by means of a knob 162, belt 163, a pulley 166, a threaded rod 167 and a stopper 164. In the arrangement shown in FIG. 18, the angular displacement of the crank 161 is controlled by means of a stopper cam 165.

COPY PAPER FEEDING

Figure 20:
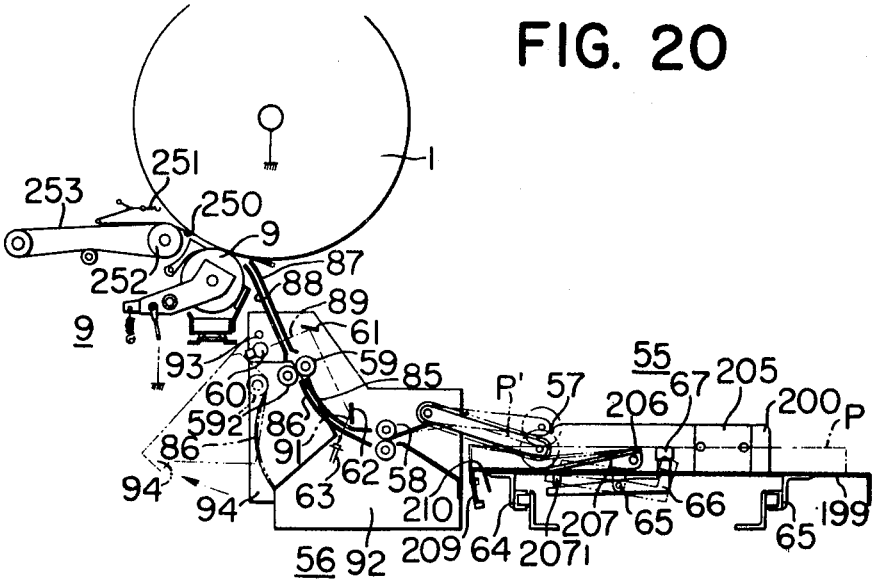
FIG. 20 is a front view of one embodiment of a passage of copy paper.
Figure 21:
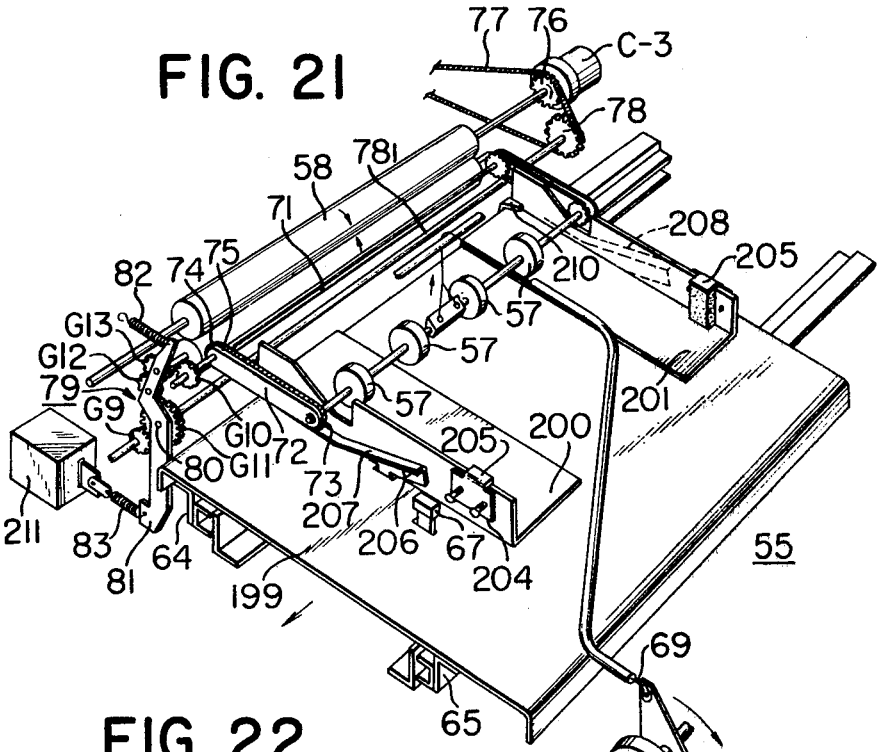
FIG. 21 is a fragmentary perspective view thereof on enlarged scale.

As shown in FIGS. 20 and 21 copy paper is fed and transported by feeding means 55 and transporting means 56.

In response to the signal from the switch MS-1 actuated by the control member CAM-1 mounted upon the drive gear $G_4$, a feed roller 57 starts to rotate to feed a copy paper P one by one into the transporting means 56, which includes a first and second pairs of feed rollers 58 and 59. The first pair of rollers 58 are rotated intermittently in response to the signal from the control member CAM-1 on the drive gear $G_4$ so as to control the timing of the transportation of the copy paper P so that the toner image developed upon the sensitive drum 1 may be transferred onto a predetermined portion of the copy paper P by the transfer means 9. In this case, it is noted that the first pair of feed rollers 58 also serves to align the leading side edge of the copy paper P in the transverse direction. The second pair of rollers 59 are normally rotating for transporting the copy paper P to the image transfer means 9.

The leading edge of the copy paper P which is fed one by one by feed rollers 57 in the feeding means 55 is stopped by the first pair of rollers 58 so that the copy paper P is bowed as indicated by the two dot lines P' in FIG. 20. Therefore the leading side edge of the copy paper P is aligned in the direction of the axes of the first pair of rollers 58. In response to the signal from the control member CAM-2, the first pair of rollers 58 start to rotate so as to transport it toward the second pair of rollers 59, which in turn transports the copy paper P toward the transfer means 9 where the copy paper 1 may be pressed against the sensitive drum 1 so that the toner image upon the sensitive drum 1 may be transferred onto the copy paper P.

A means for controlling the developing means consisting of a light source 60, mirrors 61 and 62 and a photoelectric effect element 63 is disposed in the path of the copy paper so that the passage of copy paper may be sensed and that in response to the detection the developing means 7 is controlled. When no copy paper P is fed so that a switch MS-9 is not actuated, the developing means 7 is not activated so that the electrostatic latent image upon the sensitive drum 1 is not developed and consequently the transfer means 9 in contact with the sensitive drum 1 will not be contaminated. In addition, no load is applied to cleaning rollers in the cleaning means 10.

Referring to FIGS. 20 and 21, the feeding means 55 will be described in more detail hereinafter.

A copy paper stand 199 may be readily mounted into and removed out of the main body of the photocopying machine through guide rails 64 and 65. L-shaped guides 200 and 201 are mounted upon the copy paper stand 199 on the right and left sides thereof respectively. Depending upon the size of the copy paper to be used, the right guide 201 may be displaced in the transverse direction of the copy paper stand 199 while the left side guide 200 is held stationary. Pads 205 are disposed in the notches in the L-shaped guides 200 and 201 and biased inwardly by springs 204 so as to press against the side edges of the copy papers P. By this arrangement, the undesired resistance to the copy paper may be avoided and the one-by-one separation of copy papers may be facilitated.

Separating levers 207 and 208 are tiltably fixed to the outside surfaces of the guides 200 and 201 by means of pivots 206 and at the leading or free end of each of the separating levers 207 and 208 is provided a separating claw having downwardly extending projection 209 (See FIG. 20) for engagement with the corner of the copy paper P and a horizontally extending projection 210 for pressing the corner of the copy paper from the above. The copy paper P fed by the feed roller 57 is made in engagement with the downwardly extending projections 209 so that the copy paper P is prevented from being advanced, but the center portion of the copy paper P is permitted to advanced. As a consequence the buckling of the copy paper P occurs so that the uppermost copy paper is permitted to be disengaged from the pawls and transported into the feeding means 56.

For placing the stack of copy paper P upon the feed stand 119, a set button 67 is depressed (See FIG. 20) so as to rotate an integral arm 66 in the clockwise direction, thereby raising the separating lever 207 through its downwardly extending projection $207_1$. As a consequence there is provided a clearance or space between the separating pawls 210 and the stand 199. After the stack of copy paper being placed upon the feed stand 199, the set button 67 is released so as to permit the rotation of the separating levers 207 and 208 by their own weights about their pivots 206, whereby the horizontally extending projections 210 of the separating pawls are placed over the uppermost copy paper.

When the copy paper feed stand 199 is mounted on or removed away from the main body of the photocopying machine, the feed roller 57 may be lifted by rotating a knob 68 which is connected to the feed roller 57 through a wire or the like 69. This arrangement facilitates the mounting or removal of the copy paper feed stand 199.

A plurality of feed roller 57 are carried by a shaft 70 which in turn is supported by arms 72. The arms 72 are pivotally carried by a drive shaft 71, which drives the rollers 57 through sprockets 73 and 74 and a chain 77.

The first pair of feed rollers 58 are coupled indirectly through a sprocket wheel 76 and a chain 77 so as to be rotated in response to the actuation of an electromagnet clutch C-3 (See FIG. 21). The sprocket wheel 76 is normally rotated. The chain 77 also rotates a sprocket wheel 78 carried by a shaft $78_1$. A gear $G_9$ carried by the other end of the shaft $78_1$ is connected with or disconnected from a gear $G_{10}$ carried by the drive shaft 71 through a gear clutch mechanism 79, which comprises an arm which rotates about a shaft 80, and gears $G_{11}$ – $G_{13}$ which are driven by the normally rotating gear $G_9$ carried by the arm 81. Normally the arm 81 is biased by a spring 82 so that the gear $G_{13}$ may not engage with the gear $G_{10}$.

The lower end of the arm 81 is connected to a plunger magnet PL through a cushion member 83. In response to the signal generated upon depression of the start button, the gear $G_4$ of the sensitive drum 1 rotates and when the control member CAM-1 actuates the switch MS-1, the plunger magnet PL (See FIG. 21) is energized so as to rotate the arm 81 in the clockwise direction. The gear $G_{13}$ meshes with the gear $G_{10}$ so that the feed rollers 57 are rotated, whereby the copy paper P is moved toward the first pair of rollers 58.

When the switch MS-4 is actuated by the control member CAM-4, the clutch is engaged so as to drive the first pair of feed rollers 58. Simultaneously, the plunger magnet PL is de-energized so that the clutch mechanism 79 is disconnected. As a consequence, the positive rotation of the feed rollers 57 is stopped but they rotate freely as the copy paper P is advanced.

The copy paper P is further advanced toward the second pair of feed rollers 59 through guides 85 and 86 and then into the image transfer means 9 through guides 87 and 88. An optical path indicated by 89, 90 and 91 is provided (See FIG. 20) through the guides 86–88 so that when the leading edge of the copy paper P passes through the optical path 91, the developing means is activated. The sensing position 91 which is provided by optical elements 62 and 63 is so positioned that the developing means may be activated before the latent image formed upon the sensitive drum 1 enters the developing means. When the optical path 89 is interrupted by the leading edge of the copy paper being transported, no signal is generated because the optical path 91 has been already interrupted.

When the trailing edge of the copy paper P has passed the optical path 91, no signal is generated because the optical path 89 is still interrupted. However, when the trailing edge of the copy paper P has moved past the optical path 89, the control means for the developing means is so activated as to stop the developing means.

Because of the two sensing positions or optical paths 91 and 89, the development of the latent image may be started earlier and stopped later so that a portion or area on the sensitive drum 1 larger than that of the latent image may be developed. In other words, the time required for the copy paper P to pass over a distance between the two optical paths 91 and 86 corresponds to a developing time.

The second pair of feed rollers 59 ($59_2$) are normally connected to the main drive motor MT through the chain 77 so as to be normally rotated. When the second pair of feed rollers 59 should stop by failure of operation while the copy paper P is still passing through the nip between the pair of feed rollers 59, it is extremely difficult to remove the jammed copy paper out of the transporting means 56 especially when the drive motor MT is rotating, that is without stopping the second pair of feed rollers 59. To facilitate the removal of the jammed copy paper, the feed roller $59_2$ and the guide 86 are mounted upon an auxiliary side plate 94 rotatably fixed by a pivot 93 to the side plate 92 of the main body of the transporting means 56. Therefore, the auxiliary side plate 94 may be opened as shown in FIG. 20 so that the feed roller $59_2$ and the guide 86 may be removed out of the path of the copy paper. As a consequence, the maintenance of the photocopying machine may be much facilitated.

Figure 22:
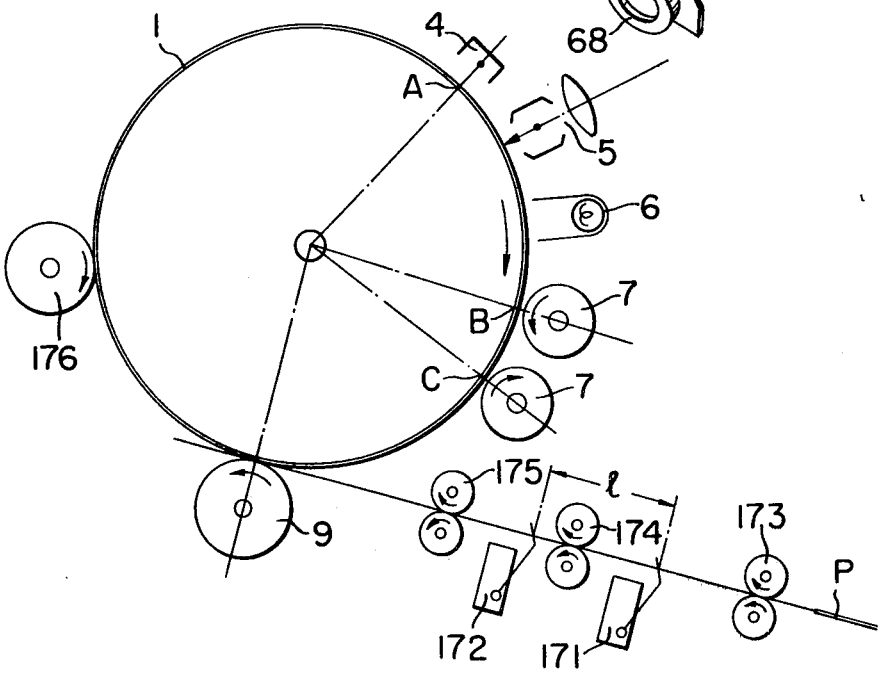
FIG. 22 is a front view of one embodiment of means for controlling the activation and de-activation of the developing means.

Another embodiment of a means for controlling the developing means in accordance with the present invention is illustrated in FIGS. 22 and 23. In the path of the copy paper there are disposed two microswitches 171 and 172 in such a way that they may be actuated by the copy paper P being transported. As shown in FIG. 23, the two microswitches 171 and 172 are connected in parallel with each other and in series to the drive motor MT for driving the developing means. S denotes a power source. The microswitch 171 is located in such a position where the leading edge of the copy paper P actuates the microswitch 171. when the leading edge A of the latent image upon the sensitive drum 1 reaches the development start position B of the developing means 6 or slightly before the point B. The second microswitch 172 is spaced apart from and in front of the first microswitch 171 by a distance l which is equal to or slightly longer than the effective developing length of the developing means 6.

When the leading edge of the copy paper P which is transported in synchronism with the rotation of the sensitive drum 1 actuates the first microswitch 171 so as to make it, the drive motor MT is started so as to start the developing operation. Even when the leading edge of the copy paper P activates the switch 172, no signal is generated because the microswitch 171 has been already closed. In a similar manner even when the microswitch 171 is opened there is no change because the microswitch 172 is still closed. Only when the trailing edge of the copy paper P deactivates or opens the microswitch 172, the circuit of the motor MT is opened so that the developing means is stopped. In other words, the latent image on the sensitive drum 1 is developed from its leading edge A by a length corresponding to the length l over which the copy paper P is transported. The length of an area of the sensitive drum developed during a time interval between the time the first microswitch 171 is closed and the time the second microswitch 172 is opened is equal to the length of the copy paper P.

IMAGE TRANSFER MEANS AND SEPARATING MEANS

The copy paper transported from the copy paper feeding means 55 by the first and second feed rollers 58 and 59 is pressed against the toner image upon the sensitive drum 1 by the image transfer roller, which is preferably made of conducting material.

The separating means is disposed at or in the vicinity of the transfer means so as to separate the copy paper from the sensitive drum after image transfer.

A separating band 250 is interposed between the copy paper P and the sensitive drum 1 along the arc of the drum as shown in FIG. 20. For example the band 250 is made of a polyester film of 50μ in thickness and is disposed along at least one side edge of the copy paper so as to overlap about 10 mm with the copy paper. A spring 251 is connected to one end of the separating band 250 so as to tension it. A separating roller 252 disposed immediately after the image transfer means 9 rotates at a peripheral speed faster than that of the sensitive drum 1, and the separating band 250 is wrapped around an arc less than 180° of the separating roller 252 and extended in the direction away from the sensitive drum 1. After the image transfer, the side edge of the copy paper P is separated from the sensitive drum 1 by the separating band 250 and transferred upon a belt 253 so that the copy paper P may be positively moved away from the sensitive drum 1 and transported into the fixing means by the conveyor belt 253.

FIXING MEANS

Figure 25:
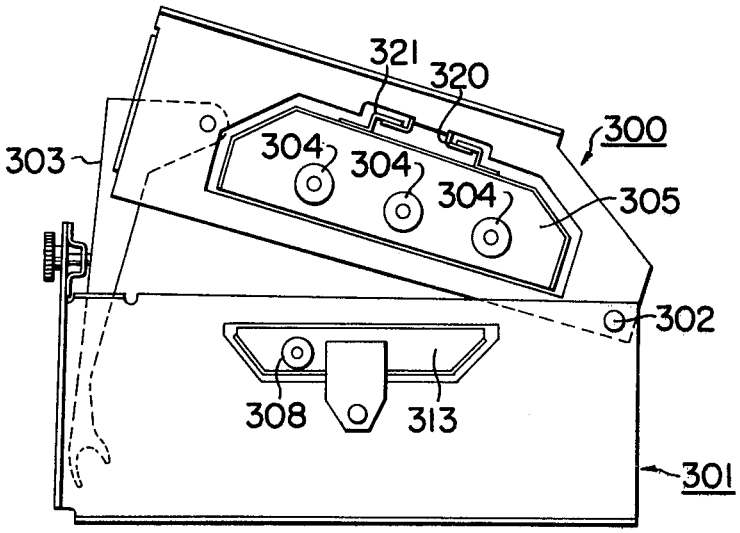
FIG. 25 is a front view thereof.
Figure 26:
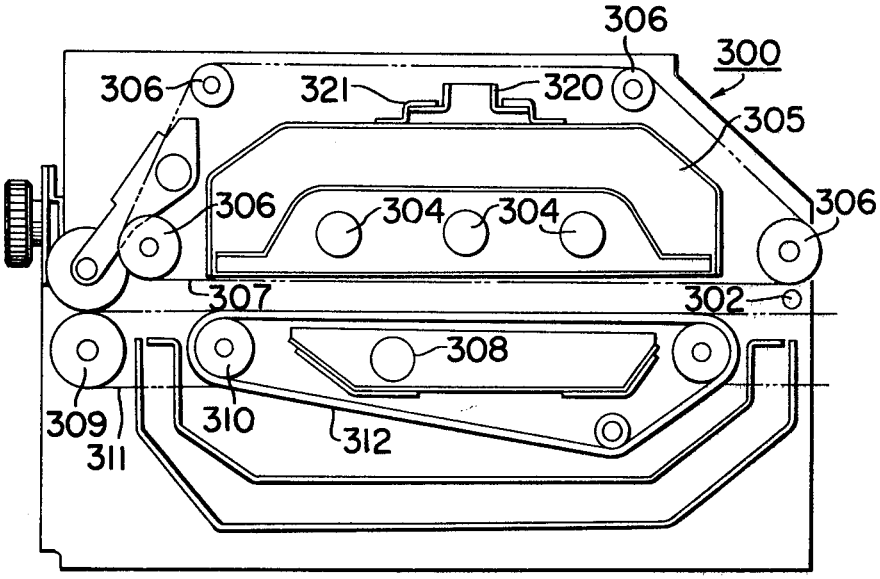
FIG. 26 is a longitudinal sectional view thereof.

As shown in FIGS. 24, 25 and 26, the fixing means comprises an upper and lower fixing chambers 300 and 301. The upper fixing chamber 300 is rotatably fixed to the lower fixing chamber 301 by a pivot 302 so that the upper chamber 300 may be opened. The upper chamber 300 may be retained in opened position by means of a supporting arm 303. This arrangement facilitates the removal of the jammed copy paper from the fixing means.

The upper fixing chambers 300 comprises an upper fixing means 305 having infrared lamps or heaters 304, sprockets 306 disposed around the upper fixing means 305 and a chain 307 wrapped around the sprockets 306 so that the contact of the copy paper with the lamps or heaters 304 may be prevented. The upper fixing means 305 is so arranged as to be drawn from the upper fixing chamber 300 toward the operator along guides 320 and 321.

The lower fixing chamber 301 comprises a lower fixing means 313 having an infrared lamp or heater 308, sprocket wheels 309, chain belt rollers 310, a chain 311 and a chain belt 312 for transporting the copy paper through the fixing means. The lower fixing means 313 may be also removed out of the lower fixing chamber 301 toward the operator along guides.

Since the fixing means is divided into the two sections as described above, the maintenance and repair may be much facilitated.

A guide plate or baffle plate 314 (See FIG. 24) is disposed in the upper portion of the upper fixing chamber 300 so that the heated air in the upper chamber 300 may be directed along the baffle plate 314 by a fan 315 so as to be discharged out of the fixing means. Therefore the overheating of the fixing means may be prevented. It is noted that the baffle plate 314 is disposed in such a way that the side edge on the side of the fan 315 of the baffle plate may be located higher than the opposite side edge as shown in FIG. 24.

CLEANING MEANS

Figure 27:
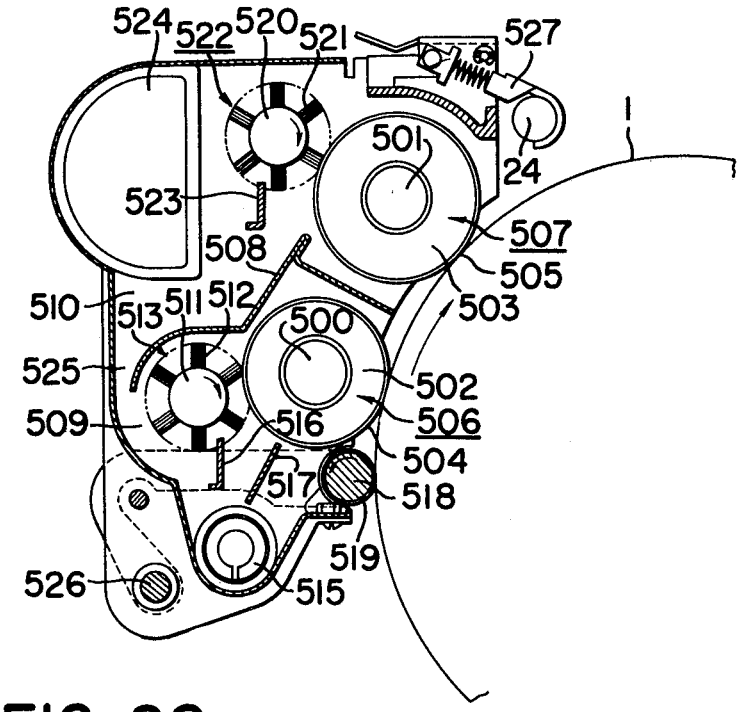
FIG. 27 is a sectional view of one embodiment of cleaning means in accordance with the present invention.
Figure 28:
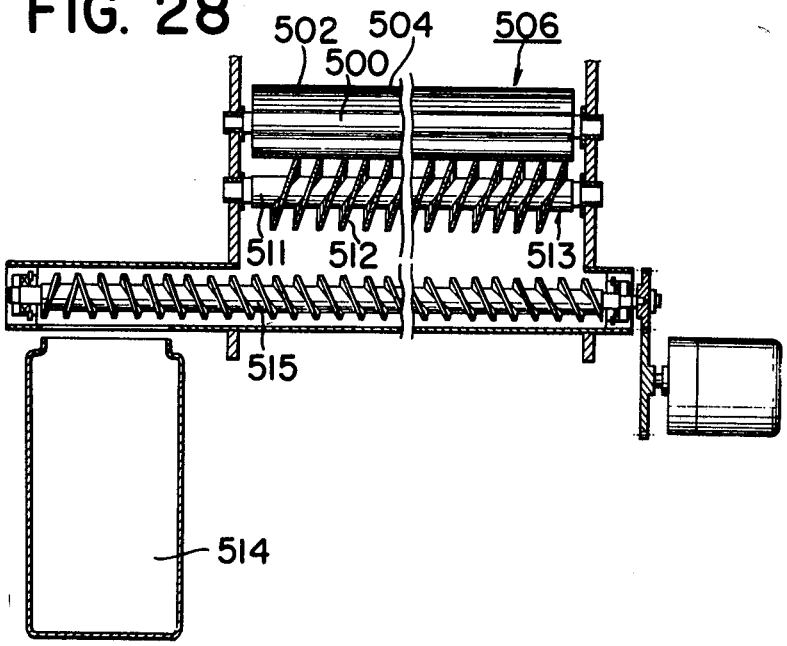
FIG. 28 is a fragmentary top view thereof on enlarged scale.

Cleaning rollers 506 and 507 are pressed against the sensitive drum 1 and rotated in the direction opposite to that of the sensitive drum 1 (FIGS. 27 and 28). Each cleaning roller comprises a roller 502 and 503 made of an elastic material and carried by a shaft 500 or 501 and a cleaning cloth 504 and 505 wrapped around the outer surface of the roller 502 and 503, respectively.

Cleaning means comprises a first and second cleaning chambers 509 and 510 separated by a partition wall 508. The first cleaning chamber 509 houses the first cleaning roller 506, a brush roller 513 and a screw conveyor 515 for transporting the toner brushed off from the first cleaning roller 506 by the brush roller 513 toward a toner receiving container 514. The brush roller 513 comprises a shaft 511 and brushes 512 secured thereto in spiral or radial form. The brushes 512 contact with the cleaning roller 506 so as to scrape off the toner.

An upright beating plate 516 disposed transversely of the first cleaning chamber 509 is for engagement with the brush 512 of the brush roller 513 to drop the toner caught between the brushes. The toner dropped is directed by a guide plate 517 toward the screw conveyor 515.

At the front entrance of the first cleaning chamber 509 is disposed a roller 518 which is spaced apart from the sensitive drum 1 by a predetermined distance and rotated in a direction indicated by the arrow for preventing the toner from being dropped off into the portion other than the cleaning means. The spacing between the roller 518 and the sensitive drum 1 may be provided by spacer-bearings 519 which rotate freely in contact with the sensitive drum 1.

The second cleaning roller 507 in the second cleaning chamber 510 serves to remove the toner on the sensitive drum 1 which has not wiped off by the first cleaning roller 506. The second cleaning chamber 510 houses the second cleaning roller 507, a brush roller 522 similar to the brush roller 513 in the first cleaning chamber 509, and an upright beating plate 523 similar to the upright beating plate 516 in the first cleaning chamber for removing the toner from the brush roller 522. The second cleaning chamber 510 is provided with a suction port 524 for sucking the toner which is scattered like mist. A suction means (not shown) is disposed in the lower portion of the photocopying machine and contains a dust collection bag into which is collected the toner. The toner whose particle size is larger is dropped through a slit 525 between the partition wall 508 and the housing of the cleaning means toward the screw conveyor 515 in the first cleaning chamber 509. The fixing means is rotatably fixed to the main body of the photocopying machine by a shaft 526 and is retained in position by means of a spring-loaded hook 527 which is hooked with the stay 24 of the sensitive drum unit, so that the both of the cleaning rollers 506 and 507 may be pressed against the sensitive drum 1 with a suitable pressure. When the sensitive drum 1 is removed or when the cleaning rollers are to be replaced, the cleaning means may be moved away from the sensitive drum 1 in the counterclockwise direction.

Another embodiment of the cleaning means in accordance with the present invention is illustrated in FIGS. 29 through 34. Two cleaning rollers 531 and 532 are disposed in parallel with each other, pressed against the sensitive drum 1 and rotated in the direction opposite to that of the sensitive drum 1. The peripheral surface of the cleaning rollers 531 and 532 are applied with for example suede-finished cloth.

Brush rollers 535 and 536 are rotated in the direction opposite to that of the cleaning rollers 531 and 532 in contact therewith. Upright beating members 537 and 538 are disposed so as to engage with the leading edges of brushes of the brush rollers 535 and 536 so as to remove the toner. The toner scattered in the cleaning means may be collected through a suction port 539. The air flow into the suction port may be less than $0.8m^3$/minute. A baffle plate 540 is disposed so as to prevent the contamination of the cleaning roller 531 by the toner dropped from the cleaning roller 532. The baffle plate 540 has a downwardly extending baffle plate $540_1$ for directing the toner scattered in an angular range defined by angles of 20° above and below the line X-Y toward a screw conveyor 543. The toner scattered may be directed toward the suction port 539 through an opening $540_2$ formed in the baffle plate 540. A partition wall 541 is provided for preventing the scattered toner from reaching a sheet 552. Another baffle plate 542 is provided so as to direct downwardly the toner scattered in an angular range defined by the angles of 20° above and below the line X-Y from the brushes 536 by the beating member 538 and to prevent the scattering of the toner within the cleaning means. The screw or spiral conveyor 543 serves to transport the toner dropped thereupon to a toner collection box 553. The above parts 531–543 are disposed within a housing 544 and spaced apart from each other by a suitable distance. The housing 544 is rotatably fixed by a pivot 545 so that the housing may be moved away from the sensitive drum 1. A hook 547 loaded with a spring 546 engages with the stay 548 of the main body of the photocopying machine so as to retain the cleaning means in operative position where the cleaning rollers 532 are pressed against the sensitive drum 1. The contact pressure of the cleaning rollers 531 and 532 may be adjusted by the spring 546. A cover 549 for the cleaning means is fixed to the housing 544 by setscrews 551. The sheet 552 is made in contact with the sensitive drum 1 at an angle about 15° in such a way that the sheet 552 will not remove the toner upon the sensitive drum 1. The sheet 552 is made of a soft material such as polyester film 150 microns in thickness and serves to prevent the toner from dropping from the cleaning means into the space between the sensitive drum 1 and the housing 544. The toner impinged upon the sheet 552 is directed toward the screw conveyor 543. An air inlet window 558 is provided above the roller 532.

The toner T remained on the surface of the sensitive drum 1 is almost wiped off by the first cleaning roller 531 and the toner T' still remained on the sensitive drum 1 is completely removed by the second cleaning roller 532. The toner attached to the cleaning rollers 531 and 532 is removed by the brush rollers 535 and 536 so that the clean surfaces of the cleaning rollers 531 and 532 may contact with the sensitive drum 1. The toner-contaminated brush rollers 535 and 536 are cleaned by the beating members 537 and 538 so that the clean brushed may contact with the cleaning rollers 531 and 532.

The toner removed from the cleaning roller 531 and dropped naturally may be directed by the sheet 552 and the horizontal portion of the partition wall 541 toward the screw conveyor 543. The toner attached to the cleaning roller 531 is removed by the brush roller 535 and dropped upon the screw conveyor 543. The toner removed by the cleaning roller 532 and the brush roller 536 is directed toward the screw conveyor 543 along the baffle plate or partition wall 540. The toner removed by the beating members 537 and 538 from the brush rollers 545 and 537 is also dropped upon the screw conveyor 543. The toner dropped upon the screw conveyor 543 is transported to the toner collection box 553. The toner scattered when the beating member 538 strikes the brush roller 536 is directed downward by the baffle plate 542 and is collected in a collecting means (not shown) disposed outside of the cleaning housing 544 through the suction port 539. Thus the interior of the housing 544 of the cleaning means may be always kept clean.

When the special cleaning of the cleaning means is required or when the brushed 535 and 536 are to be replaced, the setscrews 551 are unscrewed so as to open the cover 549. The housing 544 of the cleaning means may be rotated about the pivot 545 for inspection and maintenance of the sensitive drum 1.

For example the hardness of the cleaning rollers 531 and 532 is 20°; the diameters are 50 and 60 mm respectively; the rotating speed is about 1/5 to ½ rpm; and the contact pressure is about 20 to 30 kg per 270 mm.

Figure 30:
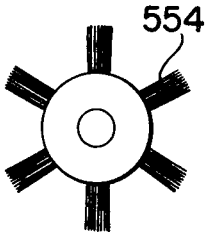
FIGS. 30 through 33 are views illustrating brushes used in the cleaning means for removing the developing agent.
Figure 31:
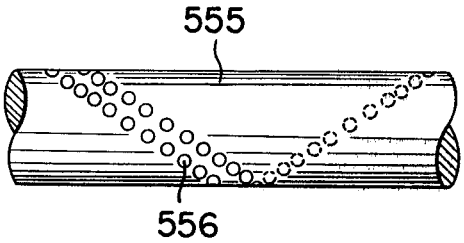
Figure 32A:
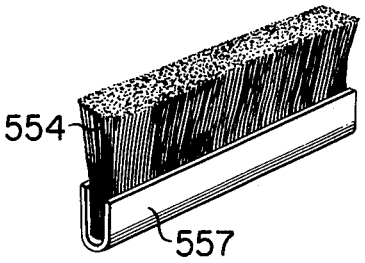
Figure 32B:
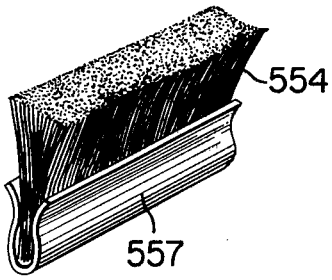

As shown in FIGS. 30 and 31, nylon brushes 554 of 200 microns in diameter and 10 mm in length are fixed in holes 556 formed in spiral forms with a pitch of 5 mm and a lead of 60 mm. Alternatively the brushed 554 may be fixed by a U-shaped metal frame 557 as shown in FIG. 32-(A) and the leg portion of the metal frame are cauked or pressed toward each other so that the brushes 554 may be firmly held in position as shown in FIG. 32-(B). Next the brush is wrapped around a shaft. A further method for providing a brush roller is to secure the brushes 554 into the spiral grooves formed in a synthetic resin shaft 555. Preferably the brush rollers 535 and 536 intersect the cleaning rollers 531 and 532 about 2 mm and rotate at about 60 rpm (in case of the outer diameters being 36 mm). If they are rotated faster, the desired cleaning effect will be improved, but the service life of the cleaning material applied on the surfaces of the cleaning rollers 531 and 532 will become shorter.

It is preferable that the brush rollers 535 and 536 intersect the beating members 537 and 538 about 2 mm. It is necessary that the beating members will not cause any damage to the brushes. The problem to be taken into consideration in this case is that the toner melts and grows on the beating members 537 and 538. Thus grown toner on the beating member tends to damage the brush, and if removed from the beating member by the rotating brush, the grown toner falls and accumulates in the housing of the cleaning means and prevents the toner fallen off from the brushes and cleaning rollers from being freely directed toward the screw conveyor. To solve this problem, the beating members are so arranged as to freely rotate when they are round bars. Alternatively, the surfaces of the round bars may be applied with fluoroplastics. When the beating members may be also in the form of plate, the melting and growing of the toner may be reduced. When the surfaces of the plates are coated with fluoroplastics, the problem of fusion and growth of toner may be completely overcomed.

FIG. 25 illustrates a method for permitting the easy application of a cleaning material such as suede-finished cloth around the outer periphery of the cleaning roller in such a manner that the cleaning material may be replaced in a simple manner. Since the cleaning material is always pressed against the sensitive drum and is also made in contact with brush roller, the wear of the cleaning material is rapid so that the toner tends to be lodged between the untwisted fibers. It will become difficult to remove by the brush roller the toner lodged so that the cleaning efficiency will be decreased. Therefore, the cleaning material should be supplied as an expendable part and replaced as needs demand.

Figure 35A:
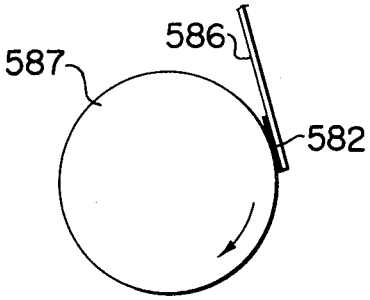
FIG. 35 is for explanation of a method for applying on and removing from a roller a cleaning material in accordance with the present invention.

A cleaning material 586 is first cut into a length slightly longer than the circumference of the roller 587 and an adhesive agent 582 such as an adhesive tape whose both surfaces are applied with an adhesive agent is applied to the margin of about 10 - 20 mm of the undersurface of the leading side edge so as to bond the cleaning material upon the cleaning roller 587 as shown in FIG. 35*a*. Next the cleaning roller 587 is rotated in the direction indicated by the arrow so as to wrap the cleaning material 586 therearound. The margin of about 10 - 20 mm at the trailing end of the cleaning material 586 is overlapped over and bonded to the leading side edge as shown in FIG. 35*b*.

Figure 29:
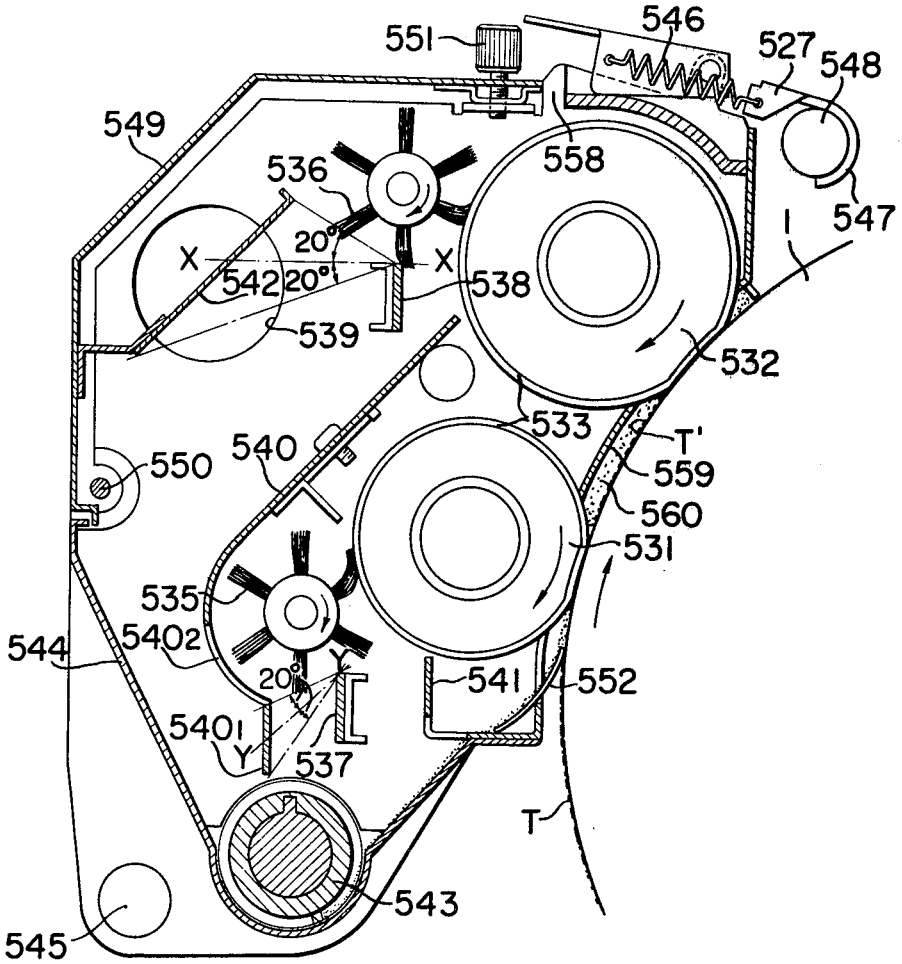
FIG. 29 is a sectional view of another embodiment of cleaning means in accordance with the present invention.

Since the cleaning roller having the cleaning material wrapped therearound in the manner described above rotates in the direction opposite to that of the sensitive drum and the brush roller as shown in FIGS. 27–29 the pressures are applied to the cleaning material in the direction of its wrapping or winding so that the cleaning material will not be loosened in cleaning operation of removing the toner from the sensitive drum 1.

Figure 35C:
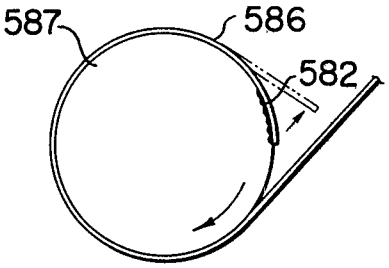
Figure 35B:
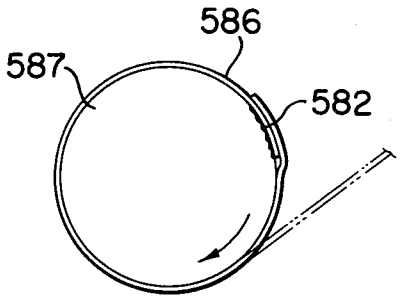
Figure 35D:
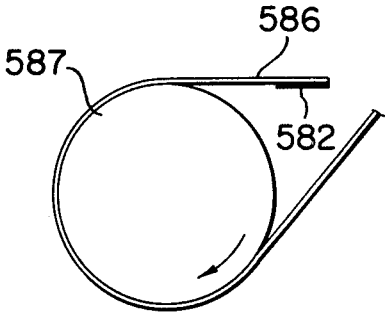
Figure 33:
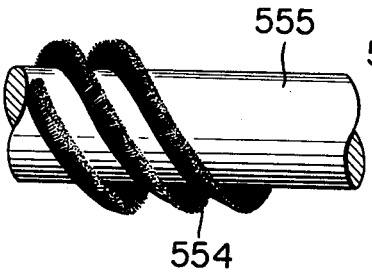
Figure 34:
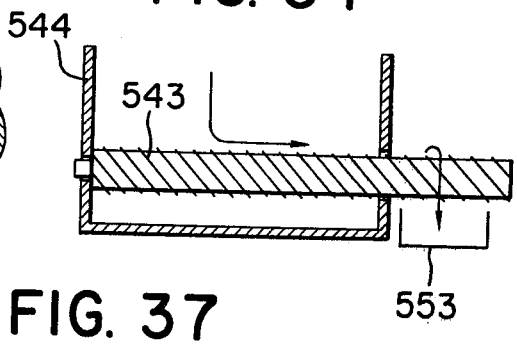
FIG. 34 is a view illustrating one embodiment of means for moving the developing agent removed in the cleaning means to a collection box.

The cleaning material 586 may be peeled off from the cleaning roller 587 in a simple manner as shown in FIGS. 35*c* and 35*d*. It is not necessary to replace the cleaning roller itself at all. Thus there is provided an inexpensive cleaning roller whose maintenance may be made by the users in a simple manner. Therefore the cleaning rollers may be always kept clean so as to produce better quality copy papers.

Since the cleaning roller 587 is drivingly coupled to the main motor through a reduction gear (reduction ratio being a fraction of a few hundred), it is impossible to manually rotate the cleaning drum 587 when the cleaning material 586 is replaced without disconnecting the cleaning roller from the main motor. However, it is not preferable to provide a complex clutch mechanism for this purpose.

Figure 36:
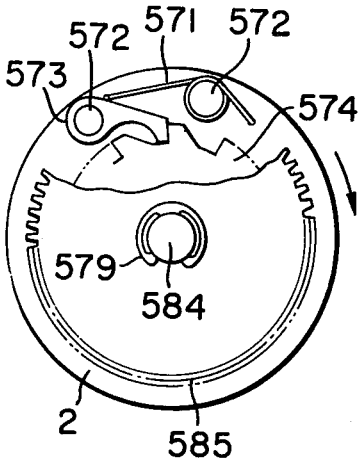
FIG. 36 is a front view illustrating means for controlling the rotation of a cleaning roller.
Figure 37:
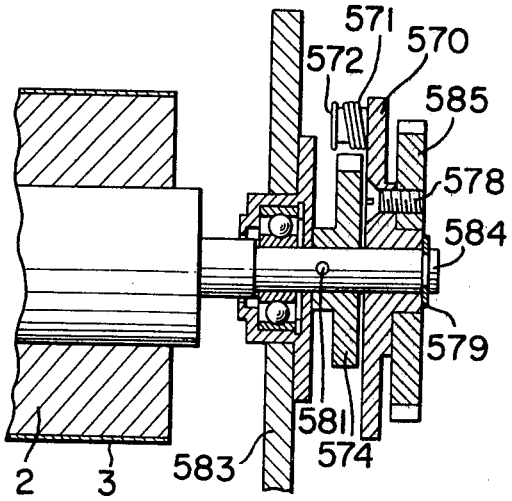
FIG. 37 is a sectional view thereof.

To overcome this problem, the present invention provides an arrangement that a ratchet wheel 574 is fixed by means of a pin 581 to the shaft 584 of the cleaning roller 587 outside of the side wall 583 of the cleaning means as shown in FIGS. 36 and 37. A ratchet pawl 573 and its bias spring 571 are fixed to a plate 570 which in turn is fixed directly or by means of screws 578 to an adjacent drive gear. 579 indicates a snap ring.

Because of the arrangement described above, the cleaning roller may be rotated freely in the direction indicated by the arrow in FIG. 36 when the cleaning means or unit is moved away from the sensitive drum so that even an unskilled operator may easily replace the cleaning material 586.

Instead of the ratchet 571 - 574, one-way clutch or the like may be used.

CHARGING MEANS

The safety and the easy maintenance are important in a photocopying machine. Therefore, in the photocopy machine in accordance with the present invention various means and methods are provided to ensure the safe and easy operation and maintenance. One of them is the charging means.

The charging means used in the photocopying machine are the first charging means 4, the simultaneous exposure-charging means 5 and the third charging means 8. Both of the first and simultaneous exposure-charging means are arranged as a unitary construction so as to be easily removed from the photocopying machine proper by lifting the unit. The third charging means 8 is also mounted so as to be easily removed out of the machine proper.

High voltage is applied to the charging means so that the disconnection of a charging electrode or wire will cause a serious condition. Therefore the present invention provides an electrical safety device for automatically disconnecting the charging means from a power source when the charging wire or electrode should be disconnected as will be described in more detail with reference to FIGS. 38 and 39.

The charging means 8 includes charging wires or electrodes 400, shield plates 401 and insulating supports 402 and 403. The insulating supporting members 402 and 403 are fixed to the ends of the shield plates 401 and a connector 404 is fixed to the supporting member 403 for connection with a high voltage power source in the main body. A knob 405 is fixed to the supporting member 402. To the insulating supporting members 402 and 403 are fixed by means of adjustment screws 408 and 409 control members 406 and 407 for controlling the positions of the charging electrodes 400. The control members 406 and 407 may be vertically moved by rotating the adjustment screws 408 and 409 so that the optimum spacing between the sensitive drum 1 and the charging electrodes 400 may be provided. The control member 407 is provided with grooves 410 for receiving therein the charging wires 400 so as to ensure the predetermined spacing therebetween within the shield plates 401. One end of each of the charging wires 400 is fixed to the insulating supporting member 402 by screws 411. The other ends of the charging wires 400 are extended through the grooves 410 of the control member 407, wrapped around pins 412, extended through a slot 413 of the supporting member 403 and fixed to a tension pin 415, which is normally biased to the left by a spring 414. The pin 415 is electrically connected to the connector 404.

If the charging wires 400 should be disconnected the tension pin 415 is displaced to the left and comes into contact with a grounding plate 416 fixed by a position adjustment pin 409 and connected with the shield plates 401, so that the high voltage is grounded. As a consequence there is no high voltage in the charging means 8.

Figure 38:
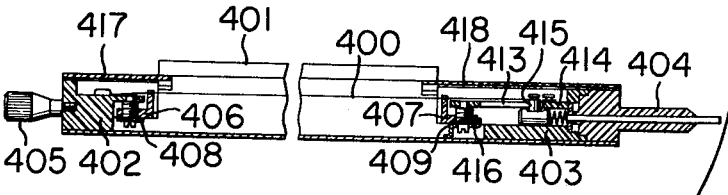
FIG. 38 is a longitudinal sectional view of one embodiment of charging means in accordance with the present invention.
Figure 40:
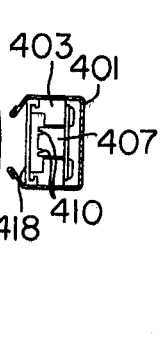
FIG. 40 is a transverse sectional view thereof.
Figure 39:
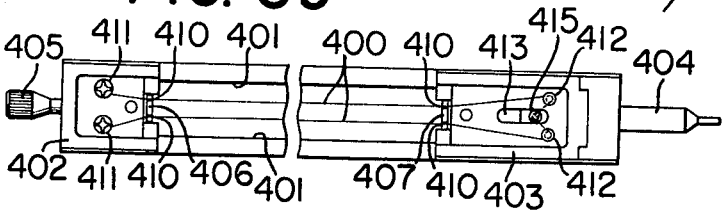
FIG. 39 is a top view thereof.

As shown in FIG. 38, insulating covers 417 and 418 are removably fixed to the supporting members 402 and 403 in such a way that the effective corona discharge generating portion will be kept exposed.

SAFETY MEANS

The positive transportation of the copy paper throughout the photocopying machine is a very important factor so that there must be provided a safety means for safeguarding the photocopying machine even when the copy paper is jammed in any means within the photocopying machine. For example when the copy paper is jammed, there must be generated a warning signal or the photocopying machine must be immediately stopped automatically.

According to the present invention, the sensitive drum 1 starts to rotate in response to the signal from the start button and the control member CAM-4 is actuated. In response to the signal from the control member CAM-4, the synchronization of the transportation of the copy paper from the first feed rollers 58 to the image transfer means 9 with the rotation of the sensitive drum 1 is attained so that the developed toner image on the sensitive drum 1 may be precisely transferred onto a desired portion of the copy paper P by the image transfer means 9. It is assumed that $T_1$ is a time interval between the time the copy paper P is started to be transported by the first feed rollers 58 and the time the copy paper P actuates a sensing means 700 (See FIG. 24) disposed outside of the fixing means. A timer (not shown) is provided which measures a time interval $T_2$ shorter than a time required for the sensitive drum to make one rotation but longer than $T_1$. The timer is so arranged as to be actuated simultaneously when the control member CAM-1 is actuated upon rotation of the sensitive drum 1. If the leading edge of the copy paper P fails to reach and actuate the sensing means 700 even after the time interval $T_2$, a warning signal is generated or the heating means such as lamps in the fixing means are de-energized. Alternatively, the photocopying machine itself may be stopped.

The sensing means 700 may be a microswitch, but it is more preferable to use a light source 701 and a photoelectric effect element 702 as shown in FIG. 24 so that the safe sensing may be attained regardless of the material of copy paper or the like.

We claim:

1. Corona discharger having a shield casing formed with a longitudinal opening defined by opposed shield plates and a discharge wire extending between two longitudinal ends of said shield casing, said corona discharger comprising:

a spring for stretching the discharge wire;

means for supporting the discharge wire in a portion of said shield casing inwardly of said shield plates and between said two longitudinal ends of said shield casing; and adjusting means for adjusting the position of said supporting means within said shield casing to maintain said discharge wire spaced from a member to be subjected to the discharge of the wire and to control the distance between the discharge wire and a surface of the member to be subjected to the discharge of the wire;

said spring maintaining a constant tension in said discharge wire regardless of the degree of adjustment effected by said adjusting means.

2. Corona discharger according to claim 1, wherein said means supporting the discharge wire are formed with recesses to receive the wire and the adjusting means are screws, one end of said wire being fixed to a tension member biased by said spring in a direction to apply tension to said wire.

3. A corona discharger according to claim 1, including, means for energizing said wire and grounding means including a tension pin and a grounding plate, said tension pin being adapted to shift under the influence of said spring means, upon failure of said wire, to contact said grounding plate and electrically ground the portion of said wire remaining charged.

* * * * *

UNITED STATES PATENT AND TRADEMARK OFFICE

CERTIFICATE OF CORRECTION

PATENT NO. : 4,089,600

DATED : May 16, 1978

INVENTOR(S) : YOSHIO ITO, ET AL

It is certified that error appears in the above-identified patent and that said Letters Patent are hereby corrected as shown below:

Col. 3, line 66, change "layer 1" to --layer 3--.

Col. 4, line 2, change "means 3" to --means 4--.

Col. 6, line 59, change "plates" to --plate--.

Col. 9, lines 62-63 delete "the circulating developing .....because".

Col. 14, line 32, after "171" delete the ".".

Col. 15, line 26, delete "an";

line 34, change "chambers" to --chamber--.

Col. 16, line 4, after "comprises" delete "a".

Col. 20, line 28, after "member" insert --406 and--; and on same line after "407" delete "is" and insert --are--.

On Title Page, under heading "References Cited", insert
--3,277,298, 10/1966, TIGER ET AL, 250/326;
3,457,405, 7/1969, DELVECCHIO, ET AL, 355/3CH;
2,882,412, 4/1959, CUNNINGHAM, 317/262A;

UNITED STATES PATENT AND TRADEMARK OFFICE

CERTIFICATE OF CORRECTION

PATENT NO. : 4,089,600

DATED : May 16, 1978

INVENTOR(S) : YOSHIO ITO, ET AL

It is certified that error appears in the above-identified patent and that said Letters Patent are hereby corrected as shown below:

3,102,193, 8/1963, DOBENS, 250/324;
3,609,484, 9/1971, SAKAMAKI, 317/262A--

Signed and Sealed this

*Twenty-fourth* Day of *July 1979*

[SEAL]

*Attest:*

LUTRELLE F. PARKER

*Attesting Officer* *Acting Commissioner of Patents and Trademarks*